US005923938A

United States Patent [19]

Enomoto et al.

[11] Patent Number: 5,923,938

[45] Date of Patent: Jul. 13, 1999

[54] RECORDING-SHEET ADSORBING APPARATUS

[75] Inventors: Yoshihiro Enomoto; Takashi Kawabata; Yukio Hayashi; Nobuo Hyakutake, all of Ebina, Japan

[73] Assignee: Fuji Xerox Co., Ltd., Tokyo, Japan

[21] Appl. No.: 08/968,706

[22] Filed: Nov. 12, 1997

[30] Foreign Application Priority Data

Nov. 13, 1996 [JP] Japan ..... 8-301499

[51] Int. Cl.[6] ..... G03G 15/01

[52] U.S. Cl. ..... 399/303; 399/66

[58] Field of Search ..... 399/66, 297, 303, 399/310, 311, 312, 313, 315, 381, 388, 304

[56] References Cited

U.S. PATENT DOCUMENTS

| | | | |
|---|---|---|---|
| 5,019,871 | 5/1991 | Takeda et al. | 399/66 |
| 5,128,717 | 7/1992 | Uchikawa et al. | 399/66 X |
| 5,132,737 | 7/1992 | Takeda et al. | 399/303 |
| 5,287,144 | 2/1994 | Takeda | 399/66 |
| 5,594,537 | 1/1997 | Hasegawa | 399/310 X |
| 5,742,867 | 4/1998 | Kodama | 399/303 X |
| 5,742,873 | 4/1998 | Kubo et al. | 399/303 X |

FOREIGN PATENT DOCUMENTS

| | | |
|---|---|---|
| 63-177181-A | 7/1988 | Japan . |
| 2-157779-A | 6/1990 | Japan . |
| 5-46031-A | 2/1993 | Japan . |

*Primary Examiner*—Sandra Brase
*Attorney, Agent, or Firm*—Oliff & Berridge, PLC

[57] ABSTRACT

The present invention prevents a recording sheet from generating wrinkles, by expanding means having an inverted crown shape pressing roll or a special sheet shape discharge restraining baffle, at the nip portion, expanding the recording sheet toward the right and left sides from the central portion in the sheet moving direction, temporal adsorbing means having discharge-output control means for an adsorbing charger or a contact pressure adjustment mechanism of the pressing roll temporarily adsorbing, in the nip portion, the leading end of the recording sheet to the dielectric film with small adsorbing force, correction means having an outer roll and an inner roll or the like disposed between the recording-sheet adsorbing apparatus and a portion for electrostatically transferring a toner image disposed downstream from the recording-sheet adsorbing apparatus applying pressure to the dielectric film to which the recording sheet has been adsorbed so that a state of adsorption of the recording sheet before a first transfer operation is performed is corrected.

32 Claims, 20 Drawing Sheets

RECORDING-SHEET ADSORBING APPARATUS

BACKGROUND OF THE INVENTION

1. Field of the Invention

The present invention relates to a recording-sheet adsorbing apparatus for use in an image forming apparatus, such as an electrophotographic copying machine, having a recording-sheet adsorbing/transporting member, such as a transfer drum, and a toner-image carrier, such as an intermediate transfer belt, and more particularly to a recording-sheet adsorbing apparatus which is capable of adsorbing a recording sheet, to which a toner image must be transferred, with an attitude exhibiting excellent flatness and smoothness with respect to the recording-sheet adsorbing/transporting member and the toner-image carrier.

2. Description of the Related Art

An electrophotographic copying machine for performing so-called multiple transfer in such a manner that toner images are sequentially stacked on a recording sheet, such as copying paper, for example, as shown in FIG. 1, applies a transfer drum 100 for electrostatically adsorbing a recording sheet P to transport the same to a position at which a toner image is transferred.

Referring to FIG. 1, reference numeral 101 represents a photosensitive drum on which a toner image is formed by an electrophotographic process. Around the photosensitive drum 101, there are formed peripheral units, such as a charger, an image exposing unit, a toner development units for black, yellow, magenta and cyan images, a cleaning unit and the like (not shown). The above-mentioned peripheral units sequentially form electrostatic latent images of color-decomposed images on the surface of the photosensitive drum 101, and then develop the electrostatic latent images with toner in the corresponding colors. Thus, toner images in the color components are sequentially formed. The toner images on the photosensitive drum 101 are sequentially transferred to the surface of recording sheet P which is adsorbed to the outer surface of the transfer drum 100 and transported to the transferring position of the photosensitive drum 101.

The transfer drum 100 for adsorbing and transporting the recording sheet P is formed by winding a dielectric film 1 having a small thickness of about 150 $\mu$m and made of PET (polyethylene terephthalate) or PVdf (polyvinylidene fluoride) around a drum frame 102 formed into a drum shape and rotatively disposed opposite to a transferring position for the transfer drum 100. On the outer and inner sides of the transfer drum 100, there are, at the positions as illustrated, disposed an adsorbing and pressing roll 2, an adsorbing corotron 3, a discharge restraining baffle 4, a transfer corotron 5, a separation corotron 103, a separation claw 104, a static-eliminating corotron 105, a cleaning unit 106 and a register roll 107. Referring to the drawing, reference numeral 6 represents a guide member for performing guiding to enable the recording sheet P to be introduced into the nip portion between the pressing roll 2 and the transfer drum 100. Reference numeral 108 represents a tie bar for connecting the right and left ring frames of the drum frame 102, and 109 represents an internally pushing member for upwards pushing the dielectric film 1 from the inside portion of the transfer drum 100 when the recording sheet is separated.

Among the above-mentioned elements disposed around the transfer drum 100, an element group consisting of the adsorbing and pressing roll 2, the adsorbing corotron 3, the discharge restraining baffle 4 and the guide member 6, or the like is called a "recording-sheet adsorbing unit". The adsorbing and pressing roll 2 forming the recording-sheet adsorbing unit is a roll made of a conductive material and having a cylindrical or columnar shape which is grounded and disposed to be brought into contact with the transfer drum 100 and separated from the same. The adsorbing corotron 3 supplies charges for adsorbing the recording sheet P to the outer surface of the transfer drum 100, that is, the charges having inverted polarity to that of toner which must be transferred are supplied to the inner surface of the transfer drum 100 (the dielectric film 1). The discharge restraining baffle 4 is arranged to restrain the discharge region of the adsorbing corotron 3 and disposed to be in contact with the inner surface of the transfer drum 100 (the dielectric film) in such a manner that it covers a portion of the adsorbing corotron 3.

The recording-sheet adsorbing apparatus having the above-mentioned structure is arranged in such a manner that the recording sheet P which is timed and transported from the register roll 107 is adsorbed to the transfer drum 100. That is, when the recording sheet P transported from the register roll 107 is introduced into a nip portion in which the rotating transfer drum 100 and the adsorbing and pressing roll 2 are in contact with each other, the adsorbing and pressing roll 2 presses the recording sheet P against the outer surface of the transfer drum 100. Moreover, charges having inverted polarity to that of the charges supplied by the adsorbing corotron 3 are injected into the sheet surface so that the recording sheet is electrostatically adsorbed to the outer surface of the transfer drum 100 (the dielectric film).

When the transfer drum 100 arranged to be rotated after it has adsorbed the recording sheet P reaches the transferring position opposite to the photosensitive drum 101, the inner surface of the transfer drum 100 is, by the transfer corotron 5, electrified with charged having the polarity opposite to that of the electrified toner on the photosensitive drum. Thus, the toner image on the surface of the transfer drum 100 is electrostatically transferred to the recording sheet P. Then, the transfer drum 100 is rotated, and then the inner surface of the drum and the transferred toner image are static-eliminated by the static-eliminating corotron 105. Then, the transfer drum 100 again transports the recording sheet P to the transferring position so that a toner image in next color is similarly transferred to the recording sheet P. Note that the adsorbing and pressing roll 2 and the cleaning unit 106 are separated from the transfer drum 100 in the second and following transferring cycles.

After the toner image of a final color component has been transferred to the surface of the recording sheet P, the separation corotron 103, the separation claw 104 and the internally pushing member 109 are operated. Thus, the recording sheet P to which toner images have been multi-transferred is separated from the transfer drum 100. The separated recording sheet P is transported to a fixing unit (not shown).

If the recording sheet P which is transported from the register roll 107 to the nip portion between the transfer drum 100 and the adsorbing and pressing roll 2 has absorbed water and thus the recording sheet P is made to be wet paper, leading end PS of the recording sheet P is sometimes waved perpendicular to the sheet transporting direction when it is transported as described above. If the waved recording sheet P is introduced into the nip portion, the thin dielectric film 1 of the transfer drum 100 is deformed attributable to an influence of the waved recording sheet P. Therefore, if waves are formed excessively, a non-adsorbed region b is, on the transfer drum 100, formed from an adsorbing region a of the recording sheet P after the recording sheet P has allowed to pass through the adsorbing and pressing roll 2. As a result, a defect in transferring the toner image sometimes takes place in the non-adsorbed region b. Note that the recording sheet is sometimes waved in the sheet transporting direction to a certain degree which sometimes causes the defective adsorption or the defective transfer to occur.

As techniques for preventing the defective adsorption and the defective transfer caused from waves of the recording sheet, there have been disclosed an apparatus (refer to Japanese Patent Laid-Open No. 2-157779) having an adsorbing and pressing roll formed into a barrel-like shape (a crown shape) having a larger diameter in the intermediate portion thereof to forcibly move the waves at the leading end of the sheet to the peripheral portions or an apparatus (refer to Japanese Patent Laid-Open No. 63-177181) arranged in such a manner that the circumferential speed of the adsorbing and pressing roll is reduced as compared with the speed, at which the recording sheet is transported, to prevent the slack of the sheet.

However, the above-mentioned two conventional techniques cannot attain a satisfactory effect. Especially, the former one of the conventional techniques causes the central portion of the dielectric film of the transfer drum to be deflected and deformed inwards by the barrel-like shape pressing roll. The state of deformation cannot be restored and removed until the sheet reaches the transferring position. Also the recording sheet is adsorbed with the shape corresponding to the deformed dielectric film. Thus, there arises a problem in that adsorption in the above-mentioned deformed state causes another defective transfer to take place. Moreover, the conventional recording-sheet adsorbing apparatus sometimes encounters a fact that waves at the leading end of the sheet are moved toward the rear end of the sheet when the sheet passes through the nip portion and accumulated waves form a great wave at the rear end of the sheet. Also the conventional technique cannot satisfactorily prevent the foregoing phenomenon.

To solve the defective transfer caused from waves of the recording sheet, also the applicant of the present invention has disclosed a technique arranged to provide a plate-like guide member having a special shape at both sides of a transporting passage of the recording sheet and in the vicinity of the nip portion with which a sheet guide passage for the recording sheet to reach the nip portion is temporarily bent in a direction apart from the transfer drum after which the passage reaches the nip portion (refer to Japanese Patent Laid-Open No. 5-46031). The foregoing structure is attempted to remove waves at the leading end of the recording sheet in a stage before the nip portion. Although the foregoing technique attains a certain degree of satisfactory advantage, the applicant has continued studies to suggest new solving means capable of obtaining the above-mentioned object.

SUMMARY OF THE INVENTION

Accordingly, an object of the present invention is to provide a recording-sheet adsorbing apparatus capable of preventing deformation disadvantageous when a dielectric film is transferred and solving defective adsorption to the dielectric film caused from waves of a recording sheet in a moment when the recording sheet has been introduced into the nip portion between the dielectric film of a transfer drum or the like and the pressing roll or a stage after the introduction into the nip portion and in front of the toner image transferring portion and thus capable of preventing defective transfer. That is, the present invention is structured in such a manner that the force for transporting the recording sheet at the two ends is larger than that in the central portion, whereby the recording sheet is expanded from the central portion to the two end. Since the foregoing state is continued from the leading end to the rear end, generation of wrinkles at the rear end, as have been experienced with the conventional structure, can be prevented.

A recording-sheet adsorbing apparatus according to a first invention for achieving the above-mentioned object includes a dielectric film disposed to be rotatively moved and formed into a drum shape or a belt shape; and a pressing roll disposed to be capable of being brought into contact with the outer surface of the dielectric film so that the recording sheet is introduced into a nip portion between the dielectric film and the pressing roll to electrostatically adsorb the recording sheet to the dielectric film, wherein expanding means is provided for expanding, in the nip portion, the recording sheet from the central portion thereof in the sheet moving direction toward right and left ends.

The recording-sheet adsorbing apparatuses to which the expanding means can be applied are classified into two types below.

One of the recording-sheet adsorbing apparatuses, has a structure that the dielectric film is used as a recording-sheet adsorbing/transporting member for adsorbing and, at least one time, carrying the recording sheet to a portion arranged to electrostatically transfer a toner-image and formed downstream in a rotational direction, an adsorbing charger for charging the dielectric film when the recording sheet is adsorbed is disposed opposite to a pressing roller on the inside of the film, and an elongated charge restraining member for restraining a discharge region of the adsorbing charger is, in a state of covering a portion of the charger, disposed to be able to press the inner surface of the dielectric film. That is, the foregoing apparatus is a recording-sheet adsorbing apparatus for use at a position at which a recording sheet is adsorbed by a recording sheet adsorbing and carrying member which is generally called as a transfer drum or a transfer belt.

Another structure of the first invention has an arrangement that the dielectric film is used as a toner carrier for carrying a toner image transferred in a toner-image electrically transferring portion, a support roll in a secondary transferring portion for supporting the rotative movement of the dielectric film is disposed opposite to the pressing roll on the inside of the film. That is, the foregoing apparatus is a transfer apparatus which is used in a secondary transfer portion in which a toner image is transferred from the toner image carrier, which is generally called as an intermediate transfer drum or an intermediate transfer belt, to the recording sheet. Also the foregoing transfer apparatus is arranged in such a manner that the transfer is performed in a state where the recording sheet is temporarily adsorbed to the toner-image carrier (the dielectric film) in the secondary transfer portion. Therefore, the foregoing apparatus is included in the sheet adsorbing apparatus.

The expanding means may have any structure if it is able to expand the recording sheet, that is, if the expanding effect can be obtained. For example, the following pressing rolls may be employed: a pressing roll structured in such a manner that the circumferential velocity of rotation at the two ends thereof is higher than that in the central portion thereof; a pressing roll structured to have force for pressing the dielectric film at the two ends thereof which is larger than that in the central portion thereof; or a pressing roll structured to have a width of contact with the dielectric film at the two ends thereof which is larger than that in the central portion thereof. The central portion and the two ends of the roll are defined as follows: the central portion is a central region of the roll in which the width of the roll is about ⅓ to ⅗ of the overall width of the roll; and the two ends are end regions of the roll obtained by bisectioning the residual portion. The regions are not limited to the foregoing description.

In the case of the expanding means using the above-mentioned pressing roll arranged to have different peripheral velocities of rotation, the recording sheet introduced into the nip portion between the pressing roll and the dielectric film is discharged in such a manner that the two ends are first discharged from the nip portion and then the central portion is discharged because the discharge speed from the nip portion is relatively higher in the two ends than that in the central portion. Therefore, the non-introduced portion (following portion) of the recording sheet is widened toward the two sides in the sheet moving direction so that waves of the sheet are removed. Also the expanding means using the pressing roll having different forces of contact is able to remove waves of the sheet because the non-introduced portion (following portion) of the recording sheet is widened toward the two sides in the sheet moving direction. Also the expanding means using the pressing roll having the different widths of contact is able to remove waves of the sheet because the non-introduced portion (following portion) of the recording sheet is widened toward the two sides in the sheet moving direction.

The pressing roll for forming the expanding means and having the above-mentioned structure may have an inverted crown shape formed in such a manner that the diameter is minimized in the central portion thereof and the diameter is enlarged in a direction toward each of the two ends thereof. If the shape of the pressing roll is specified to be the inverted crown shape, the above-mentioned two conditions of the difference in the contact forces and the difference in the contact widths except for the difference in the peripheral velocities of rotations can simultaneously be satisfied. Each of the pressing rolls has a structure which is sectioned at least between the central portion and two end portions. Specifically, each of the pressing rolls having the sectioned structure is arranged in such a manner that the peripheral velocity of the two ends rolls is made to be higher than that of the central roll; or the contact force made to be larger; or the contact widths is made to be larger.

The expanding means comprises the discharge-restraining sheet member having a structure that the width of the sheet free ends at the two ends thereof is smaller than the width of the sheet free end in the central portion thereof or structured to have force for pressing the dielectric film at the two ends thereof which is smaller than that in the central portion thereof.

In the case of the expanding means using the discharge-restraining sheet member having the different widths of the free end of the sheet or the contact forces, the contact width or the contact force of the discharge-restraining sheet member at the two ends thereof with respect to the dielectric film is smaller than that in the central portion. Therefore, the recording sheet introduced into the nip portion is brought to a state where waves can easily be moved to the two ends and thus the waves can be removed.

When the expanding means is applied to a transfer apparatus for use in a secondary transfer portion of the toner-image carrier, such as the intermediate transfer belt, a pressing roll is employed which has an inverted crown shape formed in such a manner that the diameter is minimized in the central portion thereof and the diameter is enlarged in a direction toward each of the two ends thereof.

A recording-sheet adsorbing apparatus capable of achieving the above-mentioned object and according to a second invention has a drum or a belt type dielectric film disposed to be rotatively movable and arranged to adsorb and carry a recording sheet to a portion arranged to electrostatically transfer a toner-image and formed downstream in the direction of rotation, a pressing roll disposed to be capable of pressing the outer surface of the dielectric film, an adsorbing charger disposed opposite to the pressing roll on the inside of the dielectric film and an elongated discharge-restraining sheet member, in a state covering a portion of the adsorbing charger, disposed to be capable of pressing the dielectric film to restrain a discharge region of the adsorbing charger so as to introduce a recording sheet into a nip portion between the dielectric film and the pressing roll to electrostatically adsorb the recording sheet to the dielectric film, the recording-sheet adsorbing apparatus (corresponding to the sheet adsorbing apparatus for use in the recording-sheet adsorbing and carrying member), comprising: temporary adsorbing means for temporarily adsorbing the leading end of the recording sheet in the moving direction to the dielectric film in the nip portion with adsorbing force smaller than that in a sheet portion except for the leading end.

If the temporal adsorbing means is able to obtain the above-mentioned effect of temporarily adsorbing the leading end of the recording sheet, the structure is not limited. For example, the temporal adsorbing means is discharge-output control means for controlling a discharge output from the adsorbing charger to satisfy the relationship in terms of magnitude in such a manner that "output when the leading end of the sheet passes<output when the sheet except for the leading end passes" or a contact-pressure adjustment mechanism for controlling a discharge output from the adsorbing charger to satisfy the relationship in terms of magnitude in such a manner that "contact force when the leading end of the sheet passes<contact force when the sheet except for the leading end passes" or a structure combining the discharge-output control means and the contact-pressure adjustment means. In this case, the discharge-output control means and the contact-pressure adjustment mechanism are required to have the discharge output or the contact force which is gradually or linearly enlarged in a direction from the leading end to the rear end of the recording sheet. It is preferable that the enlargement be performed linearly. Note that the leading end of the recording sheet is a sheet region inner than the leading end of the sheet in the sheet moving direction at a distance of about ¼ to ⅓ of the overall sheet.

If the temporal adsorbing means is the discharge-output control means or the contact-pressure adjustment mechanism or their combination, the adsorbing force of the leading end of the recording sheet to the dielectric film is made to be smaller than that of the rear portion without exception. Therefore, the recording sheet can easily be ironed from the leading end toward the rear end to expand the recording sheet. As a result of the ironing operation performed from the leading end of the sheet toward the rear end of the same, the waves can be removed. Moreover, undesirable accumulation of waves of the leading end of the sheet and generation of an excessively large wave because the waves are moved toward the rear end of the sheet during passage through the nip portion can be prevented.

A recording-sheet adsorbing apparatus capable of achieving the above-mentioned object and according to a third invention is the recording-sheet adsorbing apparatus according to the second recording-sheet adsorbing apparatus, wherein correction means is disposed between the recording-sheet adsorbing apparatus and a portion for electrostatically transferring a toner image formed downstream from the recording-sheet adsorbing apparatus and arranged to apply pressure to the dielectric film to which the recording sheet has been adsorbed so as to correct a state of adsorption of the recording sheet before first transfer is performed.

The correction means may have any structure if it is able to apply pressure as described above to correct the state of adsorption of the recording sheet. For example, the correction means is composed of an outer roll disposed to be enabled to be brought into contact with the outer surface of the dielectric film and moved apart from the same and an inner roll disposed to be brought into contact with the inner surface of the dielectric film at a position opposite to the outer roll. It is preferable that the outer roll has an inverted crown shape formed in such a manner that the diameter is minimized in the central portion thereof and the diameter is enlarged in a direction toward each of the two ends thereof. If the outer roll has the inverted crown shape, it is preferable that the inner roll is a crown shape roll or an elastic roll having an inverse proportional diameter relationship with the outer roll in a direction from the central portion toward the two end portions or an elastic roll.

If the correction means comprises the outer roll formed into the inverted crown shape, the dielectric film is deformed to be expanded outwards because of the influence of the shape of the outer roll. However, the foregoing deformation can easily be restored to the original flat state. Also the adsorption of the recording sheet enables the deformation to easily be restored. Thus, the state of deformation does not retained to the transfer portion.

The correction means is composed of an outer roll disposed to be enabled to be brought into contact with the outer surface of the dielectric film and moved apart from the same and an elastic sheet member disposed to be brought into contact with the inner surface of the dielectric film at a position opposite to the outer roll. In this case, it is preferable that the outer roll has the inverted crown shape.

The correction means is arranged to be operated only when a result of measurement supplied from environment measuring means for measuring an environmental state is a high humidity state. The correction means has a pressure adjustment mechanism for adjusting the pressure to be applied to the dielectric film to satisfy the relationship in such a manner that "the pressure when the leading end of the sheet passes<the pressure when the sheet except for the leading end passes".

As an alternative to this, the recording-sheet adsorbing apparatus capable of achieving the above-mentioned object and according to the present invention may be a recording-sheet adsorbing apparatus comprising at least two or more means among the expanding means, the temporal adsorbing means and the correction means.

To further reliably achieve the above-mentioned object, each of the recording-sheet adsorbing apparatuses according to the present invention may further comprise environment measuring means for measuring an environmental state and control means for, prior to performing a first transfer operation by the portion for electrostatically transferring a toner image, performing an adsorption-only cycle for idle rotating the dielectric film one time to again pass the adsorbed recording sheet under the recording-sheet adsorbing apparatus.

The control means performs control to operate the pressing roll and the adsorbing charger during execution of the adsorption-only cycle. It is preferable that the control means controls a discharge output from the adsorbing charger during execution of the adsorption-only cycle to satisfy the relationship in such a manner that "output when the sheet is adsorbed<output when the sheet is again passed".

The control means controls in such a manner that the transfer charger of the portion for electrostatically transferring a toner image is operated when the adsorption-only cycle is performed. It is preferable that the control means performs control in such a manner that a discharge output from the transfer charger during the adsorption-only cycle is smaller than a discharge output when the transfer operation is performed.

The control means performs control during execution of the adsorption-only cycle in such a manner that the operations of the pressing roll and the adsorbing charger are continued, the transfer charger of the portion for electrostatically transferring a toner image is operated and outputs from the adsorbing charger and the transfer charger satisfy the relationship as "output from the adsorbing charger when the sheet is adsorbed<output from the transfer charger<output from the adsorbing charger when the sheet is again passed".

BRIEF DESCRIPTION OF THE DRAWINGS

FIGS. 4A and 4B show an example of a usual discharge restraining baffle, in which FIG. 4A is a perspective view and FIG. 4B is a diagram showing a state of use;

FIGS. 7A and 7B show an example of a sectioned-structure pressing roll for forming the expanding means, in which FIG. 7A is a diagram showing a state of a nip of a recording-sheet adsorbing apparatus having the foregoing pressing roll and the discharge restraining baffle shown in FIG. 4, and FIG. 7B is a diagram showing a state of the nip portion shown in FIG. 7A n viewed from the pressing roll;

FIGS. 8A and 8B show another example of the sectioned-structure pressing roll for forming the expanding means, in which FIG. 8A is a diagram showing a state of a nip portion of a recording-sheet adsorbing apparatus having the pressing roll and the discharge restraining baffler shown in FIG. 4, and FIG. 8B is a diagram showing the nip portion shown in FIG. 8A when viewed from the pressing roll;

FIG. 10 is a diagram showing a state of the nip portion of a recording-sheet adsorbing apparatus having the discharge restraining baffle shown in FIG. 9 and a usual pressing roll having a cylindrical shape the like;

FIGS. 11A and 11B show an another example of the discharge restraining baffler for forming the expanding means, in which FIG. 11A is a perspective view and FIG. 11B is a diagram showing a ate of use;

DETAILED DESCRIPTION OF THE PREFERRED EMBODIMENTS

Embodiments of the present invention will now be described with reference to the drawings.

Figure 1:
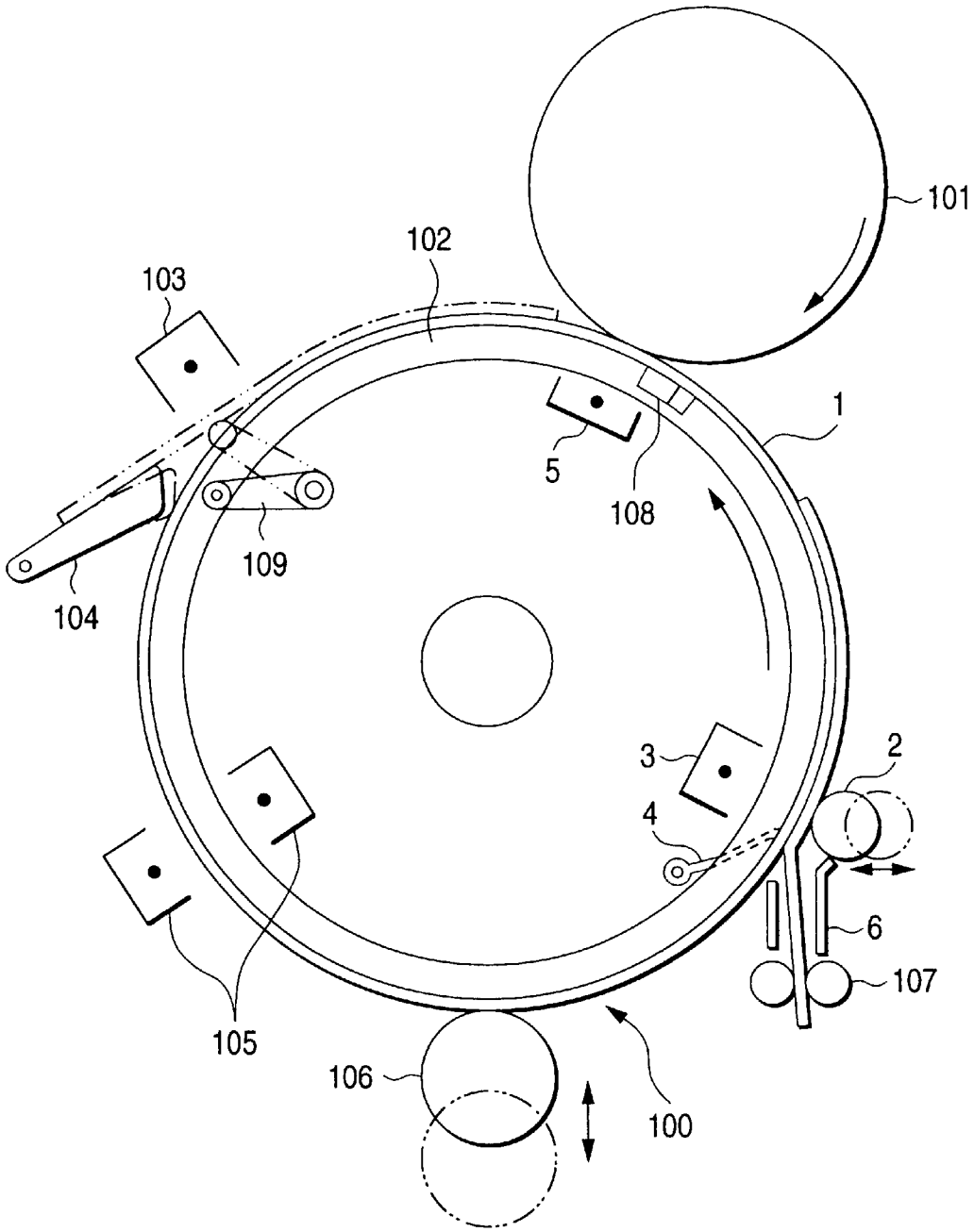
FIG. 1 is a diagram showing a state of use when the present invention applied to a position at which the transfer drum adsorbs a sheet.
Figure 2:
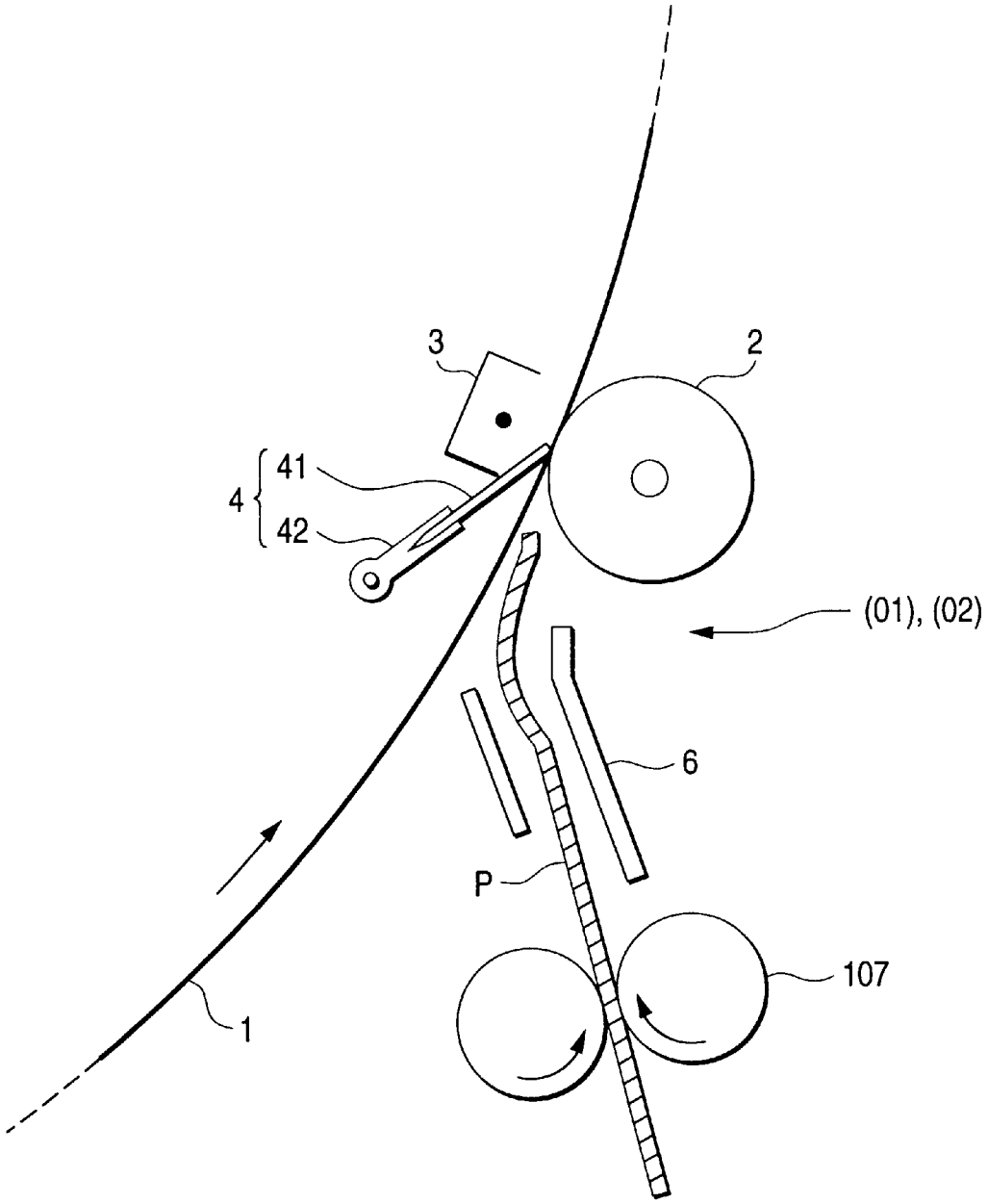
FIG. 2 is a diagram showing a basic structure of a recording-sheet adsorbing apparatus according to the present invention and applied to a transfer drum.
Figure 3:
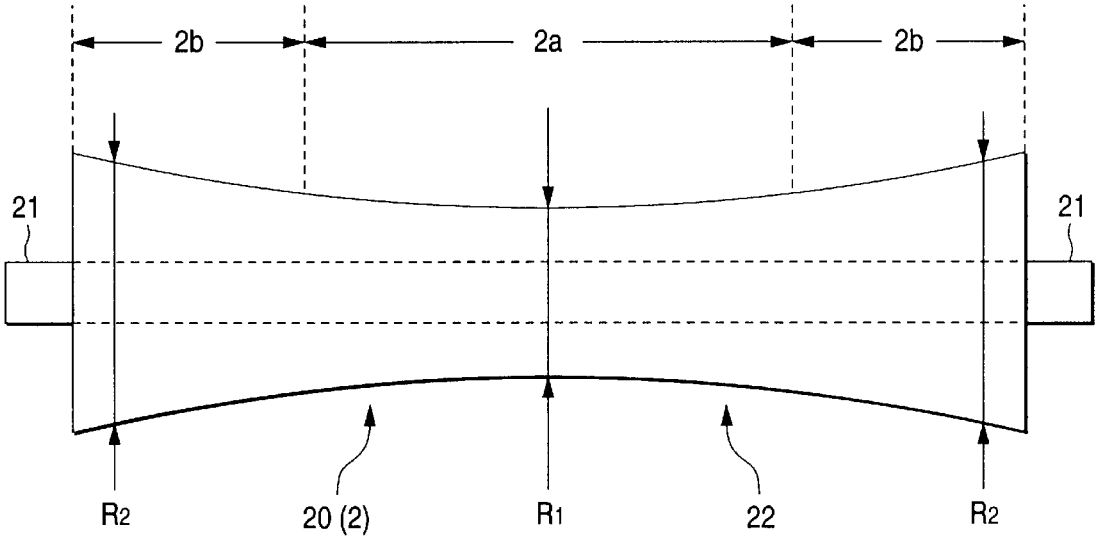
FIG. 3 is a front view showing an example of an inverted crown shape pressing roll for use to form an expanding means.

Embodiment Relating to Recording-Sheet Adsorbing Apparatus Having Expanding Means FIGS. 1 to 3 show the embodiment relating to the recording-sheet adsorbing apparatus having expanding means according to the present invention. FIG. 1 is a view of explanatory showing a state where the recording-sheet adsorbing apparatus according to the present invention is applied to a transfer drum. FIG. 2 is a schematic side view showing the overall structure of the recording-sheet adsorbing apparatus. FIG. 3 is a front view showing the structure of a pressing roll for use to form the expanding means.

The recording-sheet adsorbing apparatus (01) is, as described in the related art, used as the sheet adsorbing means for the transfer drum 100. As the pressing roll 2, a pressing roll 20 shown in FIG. 3 is employed to expand (an expanding effect) vertical waves (deformation) of the recording sheet P, which is adsorbed to the transfer drum 100 in the direction of movement of the recording sheet P from the central portion of the recording sheet toward the two ends so as to remove the waves. Thus, the recording sheet can be, in a flat state, adsorbed to the transfer drum 100, actually to the dielectric film 1 without generation of a non-adsorbed region. Note that the transfer drum 100 and the photosensitive drum 101 shown in FIG. 1 have the above-mentioned structures.

The recording-sheet adsorbing apparatus (01), as shown in FIG. 2, has a main portion including a stainless pressing roll 2 disposed to be brought into contact with the outer surface of a dielectric film 1 forming the transfer drum 100, made of PVdf and having a thickness of 150 $\mu$m, and arranged to be capable of being brought into contact with the outer surface and separating from the same, the pressing roll 2 being grounded; a adsorbing corotron 3 secured on the inside of the dielectric film 1 and arranged to be supplied with predetermined voltage from a power source (not shown); a sheet-shape discharge restraining baffle 4 disposed to press the inner surface of the dielectric film 1 in a state where the discharge restraining baffle 4 covers a portion above the adsorbing corotron 3 and arranged to restrain a discharge region of the adsorbing corotron 3; and a sheet moving guide plate 6 disposed, for example, between the pressing roll 2 and the register roll 107. In the recording-sheet adsorbing apparatus (01), the pressing roll 2 is moved away from the dielectric film 1 after the recording sheet P has been adsorbed to the transfer drum 100 (the dielectric film) so that the electrifying operation of the adsorbing corotron 3 is inhibited.

As the pressing roll 2, a pressing roll 20 is employed which has an inverted crown shape formed in such a manner that a roll body 22 having a inverted crown shape having a roll central portion 2*a* having a small diameter and two ends 2*b* each having a large diameter is provided for a roll shaft 21, as shown in FIG. 3. The roll body 22 has the diameter which is gradually enlarged from the central portion toward the two ends in such a manner that the roll diameter $R_1$ of the central portion and the roll diameter $R_2$ of each end satisfy the relationship as "$R_1<R_2$". It is preferable that the maximum roll diameter R2 of each end is about 1.1 times to about 1.3 times the maximum roll diameter R1 of the central portion. Note that pressing roll 2 is brought into contact with the rotating transfer drum 100 so as to be rotated to follow the rotations of the transfer drum 100.

Figure 4A:
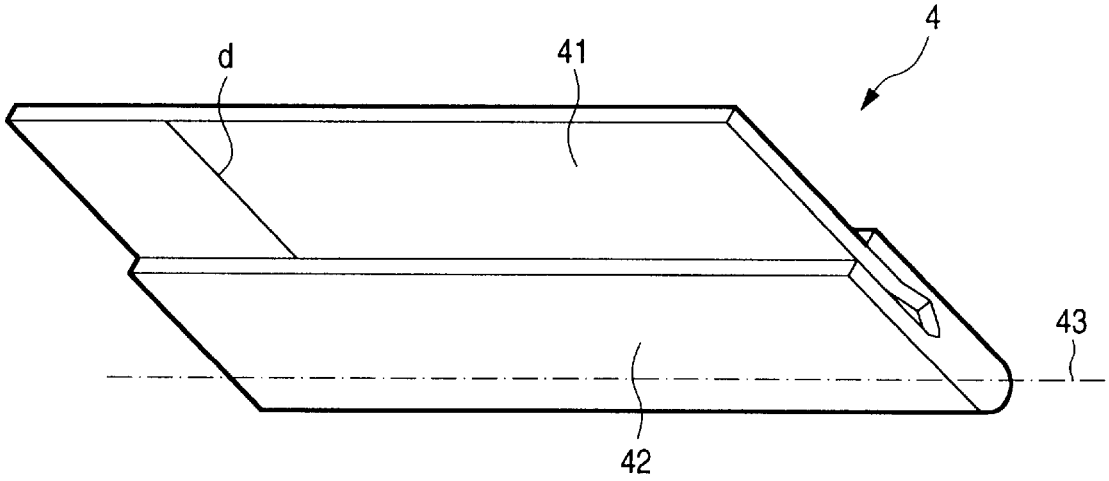
Figure 4B:
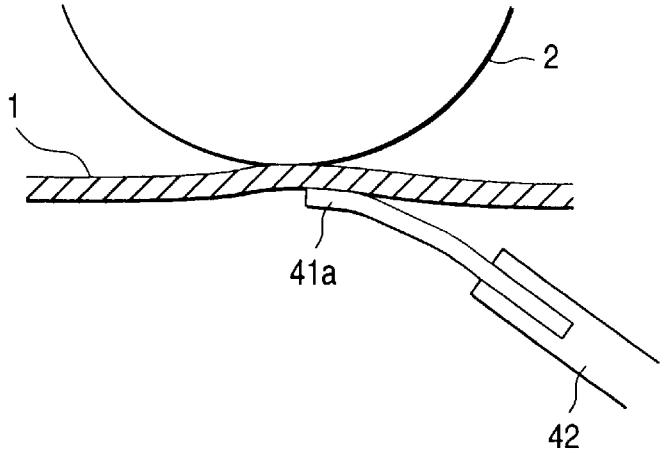

The discharge restraining baffle 4, as shown in FIGS. 4A and 4B, includes an elongated (a rectangular) sheet member 41 and a support member 42 for supporting the sheet member 41. The discharge restraining baffles 4 is attached to a frame of the apparatus (not shown) through a sheet member (a chain line) 43 in such a manner that a leading end 41*a* of the sheet member 41 presses the dielectric film 1. In general, the sheet member 41 is structured in such a manner that the width d of the free end (a portion of the sheet which is not supported by the support member) of the sheet is the same in the lengthwise direction of the discharge restraining baffle 4. The discharge restraining baffle 4 is arranged in such a manner that the leading end 41*a* of the sheet member 41 is brought into close contact with the inner surface of the dielectric film 1 of the transfer drum to bring the film 1 into close contact with the pressing roll 2 in a state where the film 1 is slightly raised.

Figure 5:
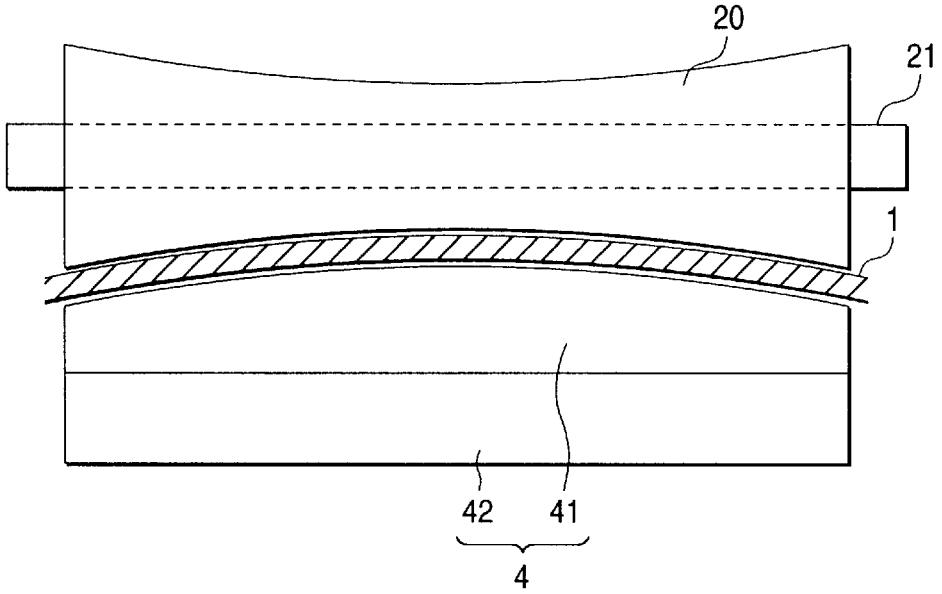
FIG. 5 is a diagram showing a state of a pressing portion (a nip portion) of a recording-sheet adsorbing apparatus having the pressing roll shown in FIG. 2 and the discharge restraining baffle shown in FIG. 4.
Figure 6:
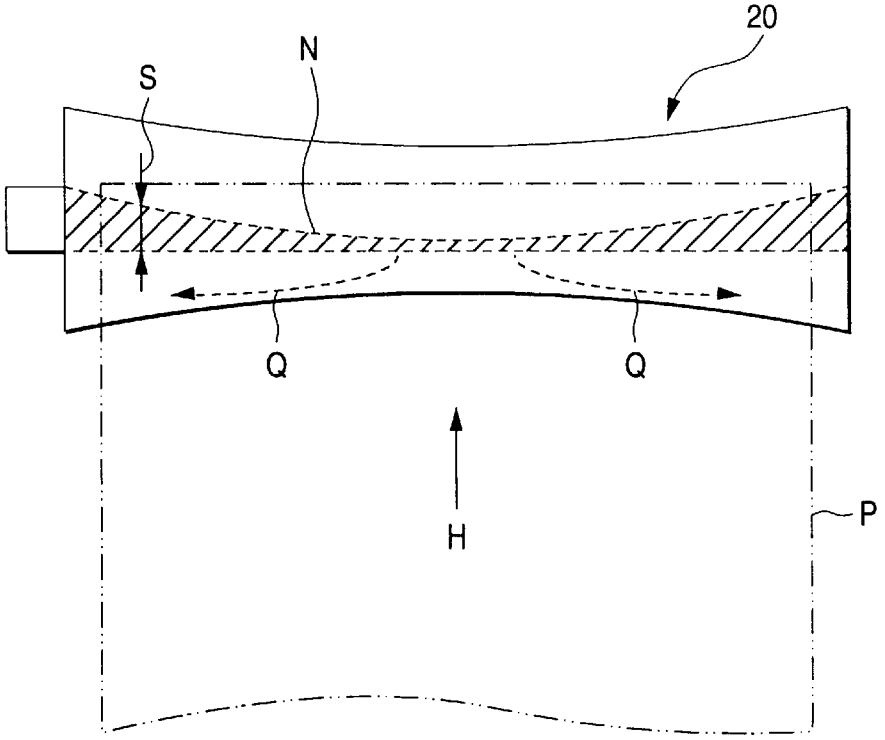
FIG. 6 is a diagram showing a state of the nip portion shown in FIG. 5 when view from the pressing roll.

The above-mentioned recording-sheet adsorbing apparatus (01), as shown in FIGS. 2 and 5, is arranged in such a manner that the dielectric film 1 is raised by the discharge restraining baffle 4 from the inner surface of the dielectric film 1 to follow and in close contact with the outer shape (the inverted crown shape) of the dielectric film 1 in a state where the pressing roll 20 is brought into close contact with the outer surface of the dielectric film 1 of the rotating transfer drum 100. Since the recording-sheet adsorbing apparatus (01) according to this embodiment is applied the inverted crown shape pressing roll 20 and the discharge restraining baffle 4 having a general elongated shape, the nip portion N in which the dielectric film 1 and the pressing roll 20 are pressed against each other is, as shown in FIG. 6, formed in such a manner that the nip (pressing) width S is small in the central portion and the same is gradually enlarged toward the two ends. Moreover, the pressing roll 20 is arranged in such a way that the contact force of the roll end having the large nip width S with the dielectric film is larger than that in the roll central portion having a small nip width S. Referring to FIG. 6, an arrow H indicates a moving direction of the recording sheet P (the dielectric film 1).

Since the recording-sheet adsorbing apparatus (01) having the above-mentioned structure is arranged in such a manner that the contact width and the contact force at the two ends of the pressing roll 2 is larger than those in the central portion, the recording sheet P having waved leading end moved from the register roll 107 and introduced into the nip portion between the pressing roll 2 and the dielectric film 1 is, as indicated with a dashed-line arrow Q, expanded from the central portion toward the two ends in the moving direction of the recording sheet P. As a result, the waves of the recording sheet P is removed because of passage through the nip portion. Then, the electrifying operation performed by the adsorbing corotron 3 causes the recording sheet P to electrostatically be adsorbed to the dielectric film 1 without generation of non-adsorbed region. Although the dielectric film 1 is, as shown in FIG. 5, expanded toward the side ends in the nip portion, the state is restored to the original flat state after the recording sheet P has allowed to pass through the nip portion. Therefore, a toner image is, in the transfer portion downstream in the rotational direction of the transfer drum 100 at a position opposite to the photosensitive drum 101, satisfactorily transferred to the recording sheet P which has satisfactorily been adsorbed to the dielectric film 1 as described above.

When multiple transfer is performed to the recording sheet P, the transfer drum 100 is rotated by the number of times corresponding to the transfer times, and then the recording sheet P is moved to the transfer portion. The recording-sheet adsorbing apparatus (01) is not operated in a state where the toner image exists on the recording sheet P.

Figure 7A:
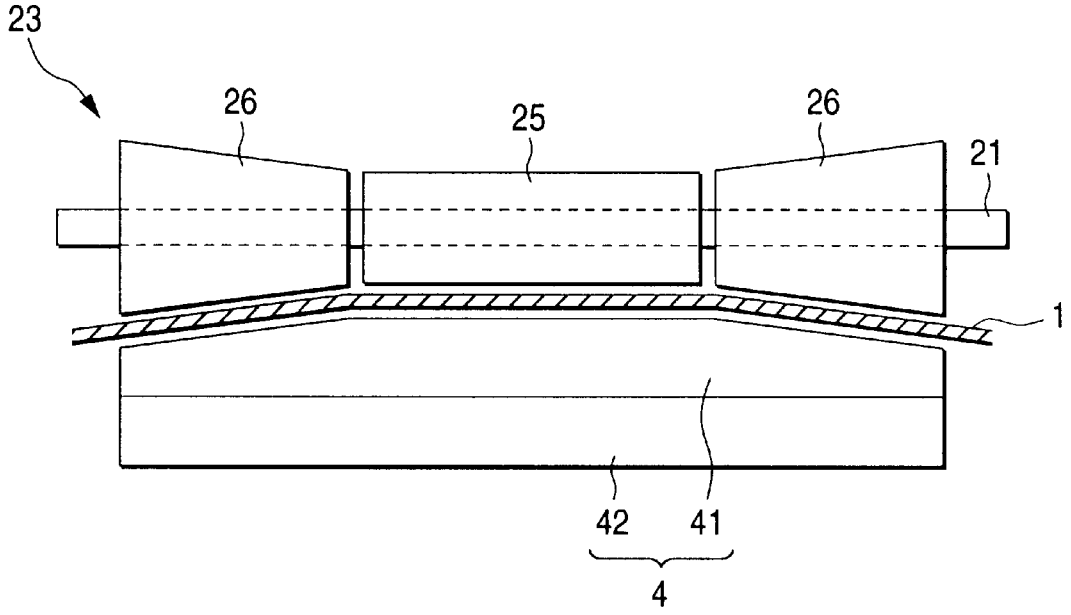
Figure 8A:
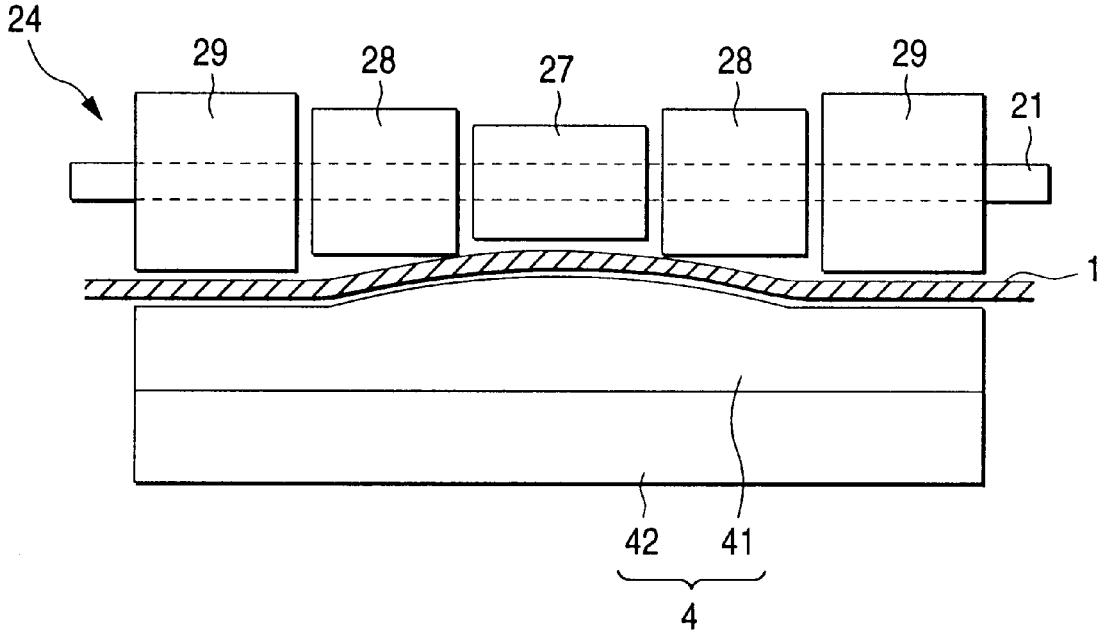

The recording-sheet adsorbing apparatus (01) may apply pressing rolls 23 and 24 having a sectioning structure as shown in FIGS. 7A and 8A as an alternative to the pressing roll 20. The sectioned type pressing roll 23 shown in FIG. 7A has a three-piece sectioned structure composed of a central sectioned roll 25 having a constant roll diameter $R_3$ and two-end sectioned rolls 26 having a roll diameter $R_4$ ($\geqq R_3$) which is gradually enlarged to the end in such a manner that the sectioned roll 25 and the sectioned rolls 26 are attached to one rotative roll shaft 21. On the other hand, the sectioned type pressing roll 24 shown in FIG. 8A has a five-piece sectioned structure composed of a central sectioned roll 27 having a constant roll diameter $R_5$, an intermediate sectioned rolls 28 each having a constant roll diameter $R_6$ and an end sectioned roll 29 having a constant roll diameter $R_7$ ($>R_6>R_5$), the rolls being attached to one rotative roll shaft 21. The number of sections of the each of the sectioned-type pressing rolls 23 and 24 is not limited particularly. It is preferable that pressing roll be sectioned bilaterally with respect to the axial direction of the roll. The number of sections is usually an odd number.

Figure 7B:
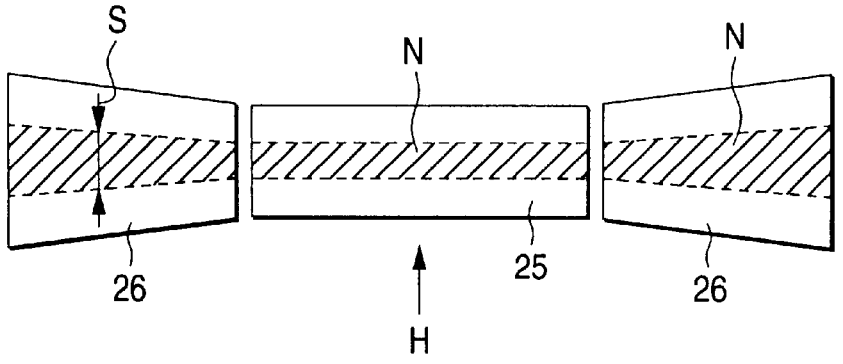
Figure 8B:
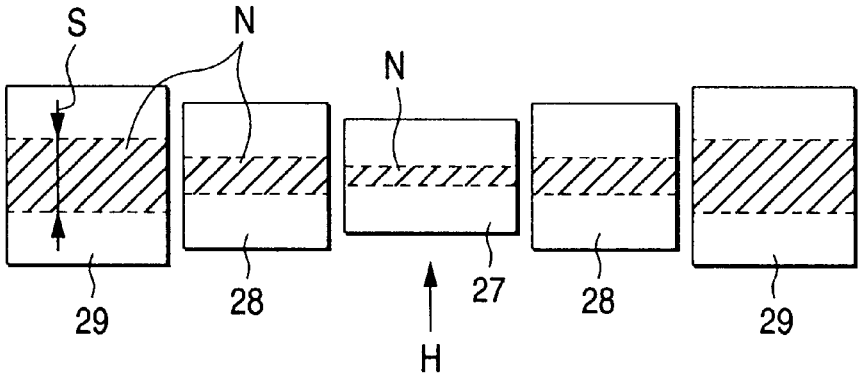

Each of the sectioned-type pressing rolls 23 and 24 enables a nip portion N in which the contact width S and the contact force at the two ends of the roll larger than those in the central portion to be obtained, as shown in FIGS. 7B and 8B. Therefore, similarly to the pressing roll 20, each of the pressing rolls 23 and 24 attains the expanding effect (see FIG. 6) for expanding the recording sheet P to the right and left ends in the nip portion N. Thus, waves of the sheet can be removed. As a result, the recording sheet P can satisfactorily be adsorbed to the dielectric film 1 without defective adsorption. Thus, satisfactory transfer without defective transfer can be performed.

When the degree of freedom of rotation of the central sectioned rolls 25 and 27 (28) of the sectioned-type pressing rolls 23 and 24 with respect to the roll shaft 21 is reduced (when easy rotation is inhibited), the peripheral velocity of rotation of each of the two end sectioned rolls 26 and 29 (28) is higher than the peripheral velocity of the central sectioned roll. Also each of the pressing rolls 23 and 24 each having the above-mentioned structure attains the expanding effect to remove waves of the sheet. The sectioned type pressing rolls 23 and 24 may be structured in such a manner that each of the sectioned roll is rotatively attached to sectioned roll shafts to make the contact pressure of each of the two end sectioned rolls 26 and 29 (28) to the dielectric film 1 to be larger than that of each of the central sectioned rolls 25 and 27 (28) so as to adjust the urging force which acts on each of the sectioned roll shafts. Also in the above-mentioned case, the expanding effect can be obtained and waves of the sheet can be removed.

Figure 9:
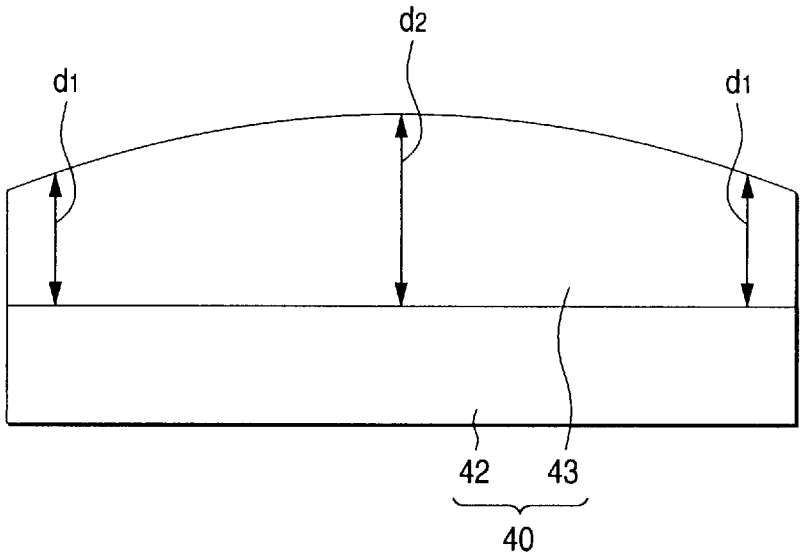
FIG. 9 is a front view showing an example of the discharge restraining baffle for forming the expanding means.
Figure 10:
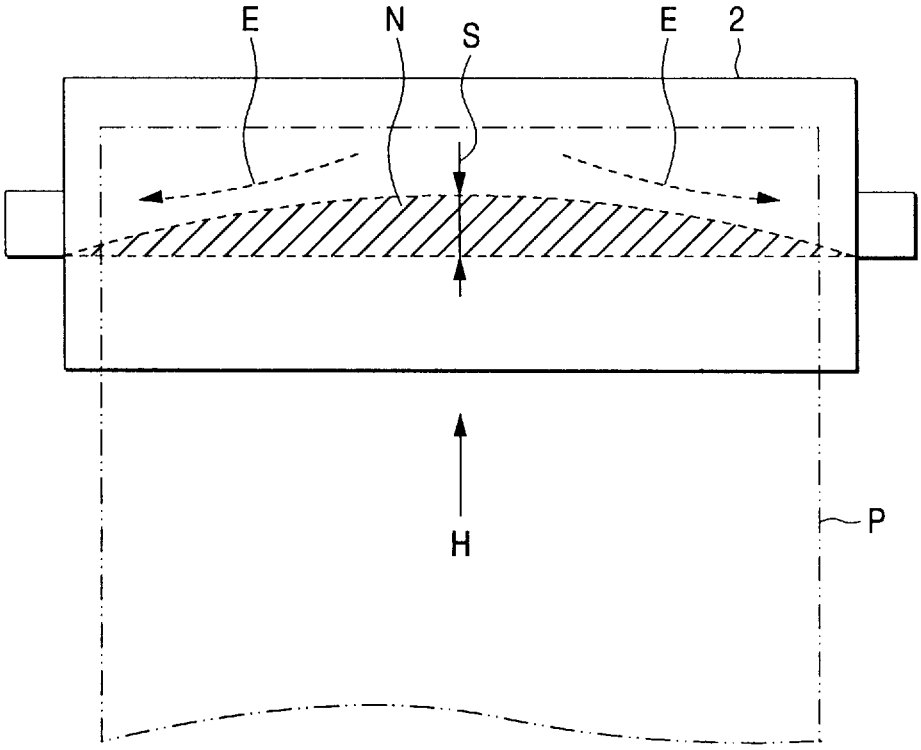

As an alternative to the general-type discharge restraining baffle 4, the recording-sheet adsorbing apparatus (01) may employ a discharge restraining baffle 40 having a sheet member 43, the structure of which is arranged in such a manner that the sheet free ends $d_1$, at the two ends is smaller than the sheet free end $d_2$ in the central portion, as shown in FIG. 9. The discharge restraining baffle 40 shown in FIG. 9 is formed by employing the sheet member 43 having a gentle parabola formed in such a manner that the leading end of the sheet has a vertex in the central portion. The structure of the discharge restraining baffle 40 has a structure formed by attaching the sheet member 43 to the support member 42. When a discharge restraining baffle 40 of the foregoing type is used, the pressing roll 2 has a shape having a roll body in the form of a cylinder (a column) as shown in FIG. 10. When the discharge restraining baffle 40 is combined with the foregoing cylindrical (columnar) pressing roll 2, a nip portion N in which the nip width S of the central portion is, as shown in FIG. 10, larger than that of each of the two ends can be realized. Thus, the recording sheet P, which is allowed to pass through the nip portion N, is expanded toward the two ends (in a direction indicated by an arrow E) because the nip width is reduced from the central portion toward the two ends and thus the holding force in the nip is reduced. As a result, waves can be removed.

Figure 11A:
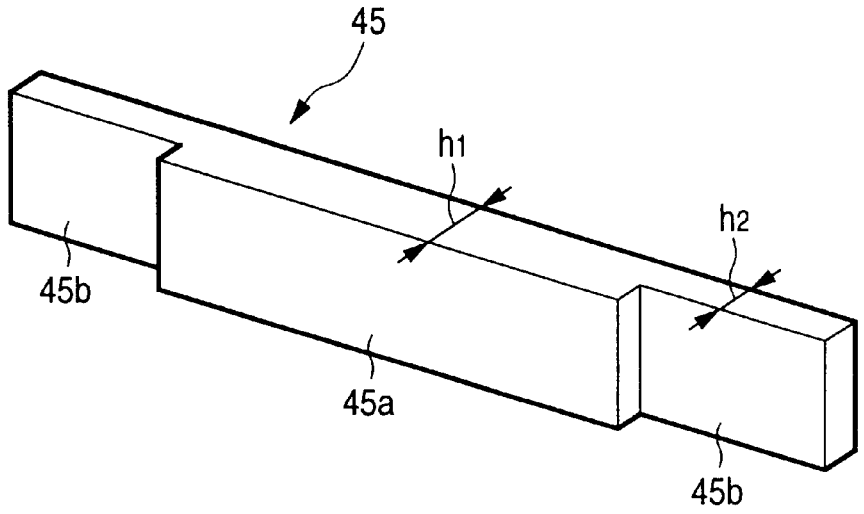
Figure 11B:
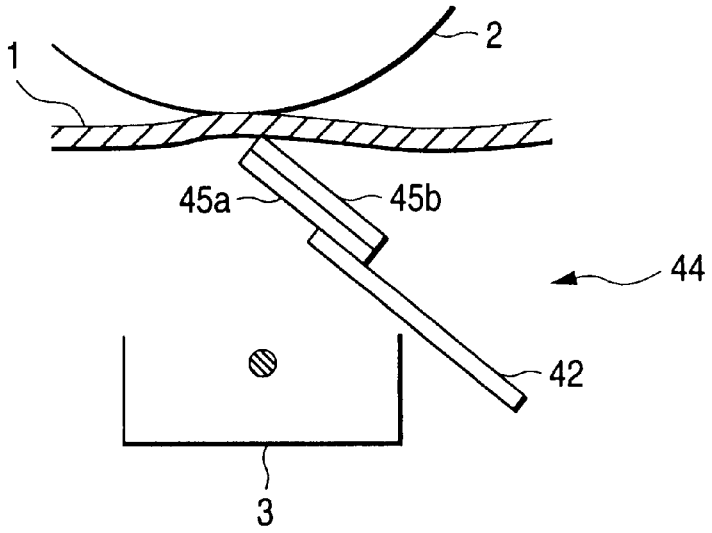

As an alternative to the usual-type discharge restraining baffle 4, a discharge restraining baffle 44 may be employed which has a structure that the contact force with the dielectric film at the two ends is smaller than the contact force in the central portion as shown in FIGS. 11A and 11B. The discharge restraining baffle 44 shown in FIGS. 11A and 11B has a structure formed in such a manner that thickness $h_1$ of a central portion 45*a* is made to be larger than thickness $h_2$ of the two ends 45*b* to make the elastic force of the central portion to be 1.2 times to 1.5 times that of each of the two ends. The sheet member 45 is attached to the support member 42. When the discharge restraining baffle 44 is employed, the contact force to the dielectric film 1 is made to be enlarged in the central portion 45*a* and that in the two ends 45*b* is reduced. As a result, the recording sheet is ironed from the central portion to the two ends so that the recording sheet P is expanded to the two ends and waves are removed.

Figure 12A:
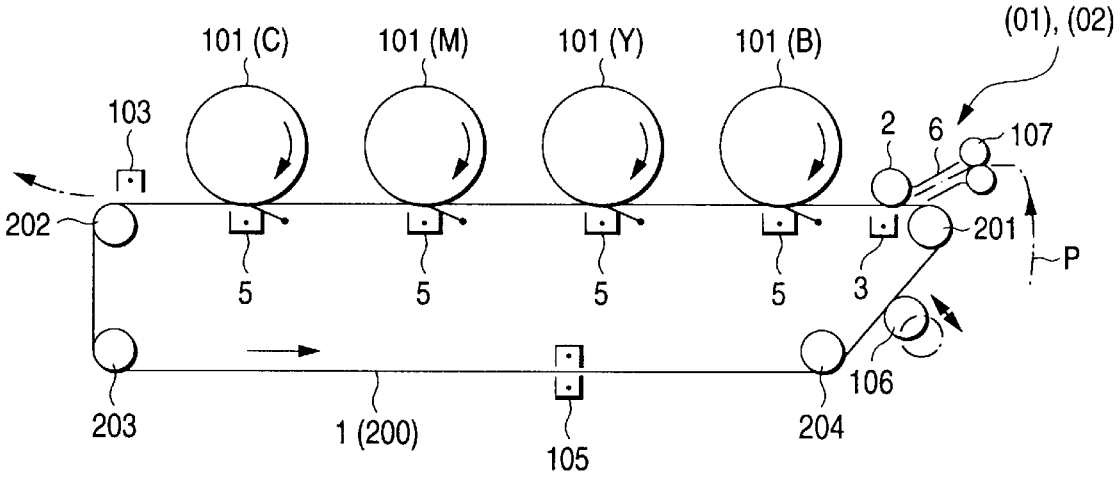
FIG. 12A is a diagram showing a state of use when the present invention is applied to a secondary transfer portion of an intermediate transfer belt.

The recording-sheet adsorbing apparatus (01) capable of obtaining the above-mentioned expanding effect can be applied to (the sheet adsorbing position) the transfer belt 200 for adsorbing and transporting the recording sheet P to transfer portion of each of a plurality of photosensitive drums 101B, 101Y, 101M and 101C on which toner images in colors (black: B, yellow: Y, magenta: M and cyan: C) by a photographic process as shown in FIG. 12A. Thus, a similar effect can be obtained. Reference numeral 201 shown in FIG. 12A represents a belt drive roll, 202 represents a separation roll, 203 represents a tension roll and 204 represents an idle roll.

In this case, the recording-sheet adsorbing apparatus (01) is mainly constructed by a pressing roll 2, a adsorbing corotron 3 and the like to thereby electrostatically adsorb the recording sheet P sent from a register roll 107 to the dielectric film 1 forming the transfer belt 200. When the recording-sheet adsorbing apparatus (01) has the inverted crown shape pressing roll 20 or the sectioned-type pressing rolls 23 and 24 as the pressing roll 2, a wet recording sheet, the waves of which have been removed by the above-mentioned expanding effect, can satisfactorily be adsorbed to the dielectric film 1. As a result, a toner image can satisfactorily be transferred with defective transfer.

Figure 12B:
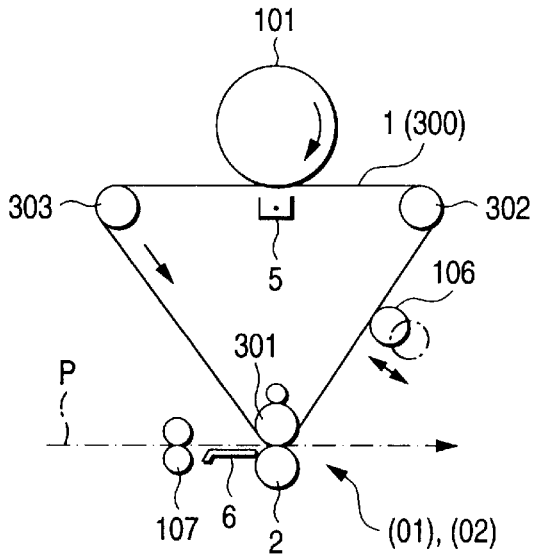
FIG. 12B is a diagram showing a state of use when the present invention is applied to a sheet adsorbing portion of the transfer belt.

The recording-sheet adsorbing apparatus (01) capable of attaining the expanding effect can be employed as a secondary transfer portion of an intermediate transfer belt 300 arranged among a plurality of belt support rolls 301, 302 and 303 (one of which is a drive roll) to be rotated in synchronization with the photosensitive drum 101 and made of the dielectric film 1, as shown in FIG. 12B. A similar effect can be obtained in this case. That is, the intermediate transfer belt 300 receives toner images which are transferred one to several times from the photosensitive drum 101 in a primary transfer portion in which the photosensitive drum 101 and the transfer corotron 5 and the like are placed opposite to each other. Then, the intermediate transfer belt 300 again transfers the toner images to the recording sheet P at a position (a secondary transfer portion) at which the pressing roll 2 and the support roll (the transfer roll) 301 are placed opposite to each other. The recording-sheet adsorbing apparatus (01) can be used in the secondary transfer portion of the intermediate transfer belt 300. Note that the recording-sheet adsorbing apparatus (01) is employed as the apparatus for adsorbing the sheet and the transfer apparatus.

The main portion of the recording-sheet adsorbing apparatus (01) is constructed by a transfer roll 301 which is in contact with an electrode roll, to which a transfer electric current is supplied, and the pressing roll 2 disposed opposite to the transfer roll 301 across the intermediate transfer belt 300 to introduce the recording sheet P sent from the register roll 107 into the nip portion between the intermediate transfer belt 300 and the pressing roll 2 to electrostatically adsorb the recording sheet P to the dielectric film 1 forming the intermediate transfer belt 300 when the transfer is performed. Since the recording-sheet adsorbing apparatus (01) applies the inverted crown shape pressing roll 20 as the pressing roll 2, the recording sheet P can satisfactorily be adsorbed to the dielectric film 1 in a state where waves of the wet recording sheet P have been removed by the expanding effect. Thus, satisfactory transfer of a toner image without defective transfer can be performed.

Figure 13:
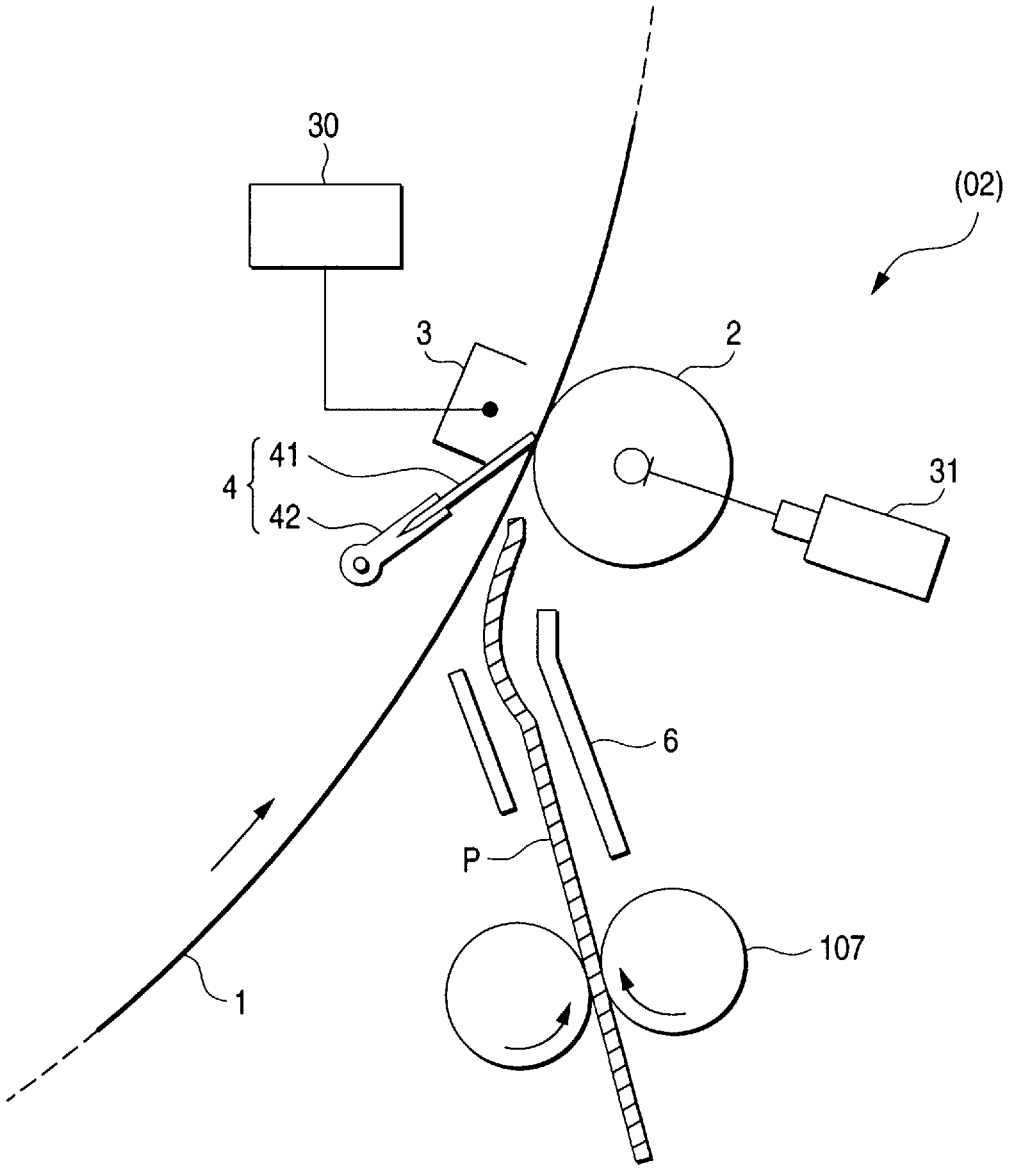
FIG. 13 is a diagram showing an embodiment of a recording-sheet adsorbing apparatus comprising a temporal adsorbing means According to the present invention.

Embodiment Relating to Recording-Sheet Adsorbing Apparatus Having Temporal Adsorbing Means FIG. 13 shows an embodiment of a recording-sheet adsorbing apparatus comprising the temporal adsorbing means according to the present invention. Although recording-sheet adsorbing apparatus (02) according to this embodiment is applied to a transfer drum 100, it may be applied to the transfer belt 200 (see FIG. 12A) similarly to the recording-sheet adsorbing apparatus (01) according to the above-mentioned embodiment.

The recording-sheet adsorbing apparatus (02) has at least one of a discharge-output control means 30 for controlling a discharge output from the adsorbing corotron 3 as shown in FIG. 13 and a contact-force adjustment mechanism 31 for adjusting the contact force of the pressing roll 2 to adsorb, to the dielectric film 1 of the transfer drum 100, the leading end of the recording sheet P in the moving direction with the force smaller than that in the other sheet portions in the nip portion between the dielectric film 1 and the pressing roll 2 (a temporal adsorption effect) so as to iron the recording sheet from the leading end toward the rear end of the recording sheet so as to remove waves so that the recording sheet P is flatly adsorbed to the dielectric film 1 without generation of a non-adsorbed region.

The main portion of the recording-sheet adsorbing apparatus (02) is constructed by a cylindrical or columnar pressing roll 2 disposed to be capable of approaching and separating from the dielectric film 1 forming the transfer drum 100, the adsorbing corotron 3, the discharge restraining baffle 4 and the sheet moving guide plate 6 similarly to the recording-sheet adsorbing apparatus (01) shown in FIG. 2, except for the discharge-output control means 30 being provided for the adsorbing corotron 3 and/or contact-force adjustment mechanism 31 being provided for the pressing roll 2 as shown in FIG. 13.

Figure 14:
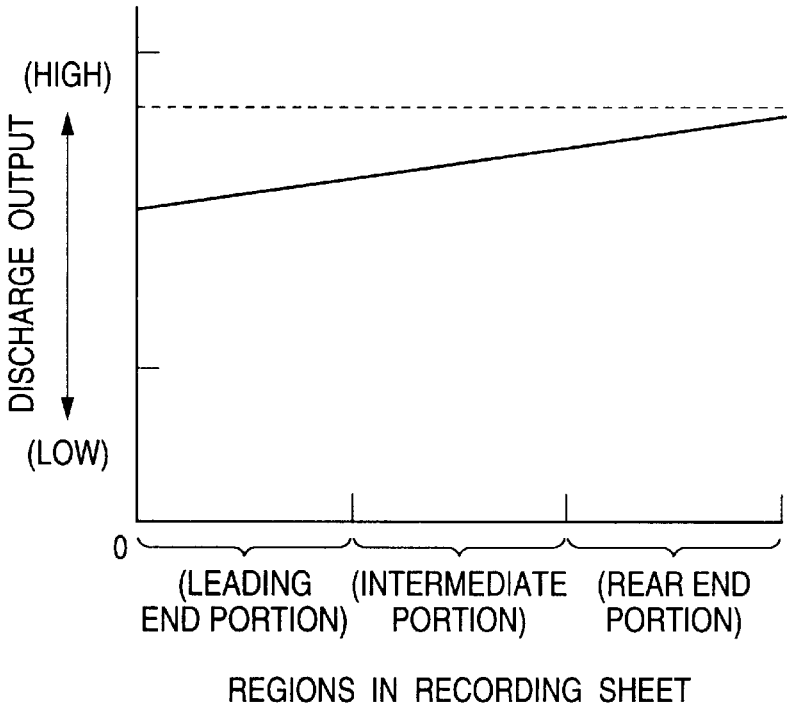
FIG. 14 is a graph an example of a discharge output from a discharge-output adjustment means.

The discharge-output control means 30 is a power supply output apparatus capable of controlling a discharge output from the adsorbing corotron 3, to a predetermined value so as to correspond to the regions of the recording sheet P in the moving direction. In this embodiment, the discharge output from the adsorbing corotron 3 is, as shown in FIG. 14, linearly enlarged in a direction from the leading end (about ⅓ of the overall region), an intermediate portion (a residual portion except for the leading end and the rear end) and the rear end (about ⅓ of the overall region) of the recording sheet P. A dashed line shown in FIG. 14 indicates a standard level of the discharge output from the conventional adsorbing corotron 3.

Therefore, the recording-sheet adsorbing apparatus (02) having the discharge-output control means 30 is structured in such a manner that a relatively weak adsorbing electric field of the adsorbing corotron 3 is applied to the leading end of the recording sheet when the recording sheet P sent from the register roll 107 is introduced into the nip portion N and allowed to pass through the same, and the adsorbing electric field is gradually intensified toward the rear end of the sheet. As a result, the leading end of the sheet is relatively weakly adsorbed to the dielectric film 1 of the transfer drum 100 as compared with the rear end portion of the sheet. Since the leading end of the sheet is relatively weakly adsorbed to the dielectric film 1 and the contact force of the nip portion irons the sheet from the leading end toward the rear end, waves in the leading end portion of the recording sheet P can be removed. Thus, the recording sheet can electrostatically and uniformly be adsorbed to the dielectric film 1 without generation of a non-adsorbed region.

Figure 15:
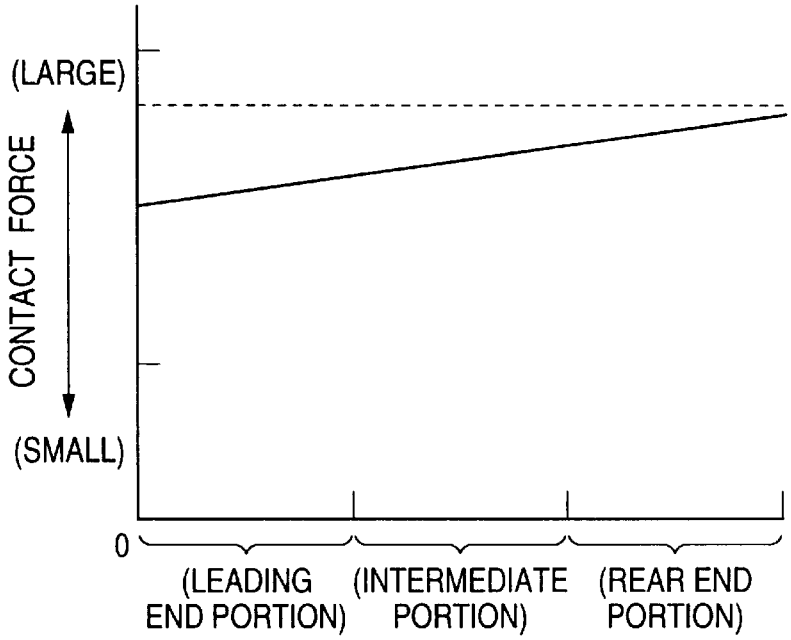
FIG. 15 is a graph showing an example of contact force of a contact force adjustment mechanism.

On the other hand, the contact-force adjustment mechanism 31 is a pressure adjustment apparatus having a cam mechanism or the like capable of adjusting, to a predetermined value, the contact force of the pressing roll 2 to correspond to the regions of the recording sheet P in the sheet moving direction. In this embodiment, the contact force of the pressing roll 2 is, as shown in FIG. 15, linearly enlarged in the leading end of the recording sheet P toward the rear end through the intermediate portion. A dashed line shown in FIG. 15 indicates a standard level of the contact force of the conventional pressing roll 2.

Therefore, the recording-sheet adsorbing apparatus (02) having the contact-force adjustment mechanism 31 is arranged in such a manner that the contact force of the pressing roll 2 is relatively weak for the leading end of the recording sheet and the force is gradually enlarged toward the rear end of the sheet when the recording sheet P sent from the register roll 107 is introduced into the nip portion N. Thus, the leading end of the sheet is relatively weakly adsorbed to the dielectric film 1 of the transfer drum 100 as compared with the rear end portion of the sheet. As a result, the ironing force for ironing waves of the leading end of the recording sheet can be reduced so that an influence of ironing of the waves in the leading end portion of the sheet from the leading end of the sheet to the rear end portion of the same is prevented. Thus, the recording sheet can electrostatically and uniformly be adsorbed to the dielectric film 1 without generation of a non-adsorbed region.

The recording-sheet adsorbing apparatus (02) according to this embodiment may be provided with both of the discharge-output control means 30 and the contact-force adjustment mechanism 31, as shown in FIG. 13. In this case, temporal adsorption of the leading end of the recording sheet P can furthermore reliably be performed by the above-mentioned two units so that also waves in the leading end pressing roll of the recording sheet P are further reliably be removed. In this case, both of the discharge-output control means 30 and the contact-force adjustment mechanism 31 are not required to always and simultaneously be operated. Either of the two units may be operated as occasion demands. The discharge-output control means 30 and the contact-force adjustment mechanism 31 may be, as shown in FIGS. 14 and 15, arranged in such a manner that the discharge output from the adsorbing corotron 3 and the contact force of the pressing roll 2 are raised or enlarged in a stepped manner in the leading end portion, the intermediate portion and the rear end portion as an alternative to linear raising or enlargement. It is preferable that they are linearly changed.

Figure 16:
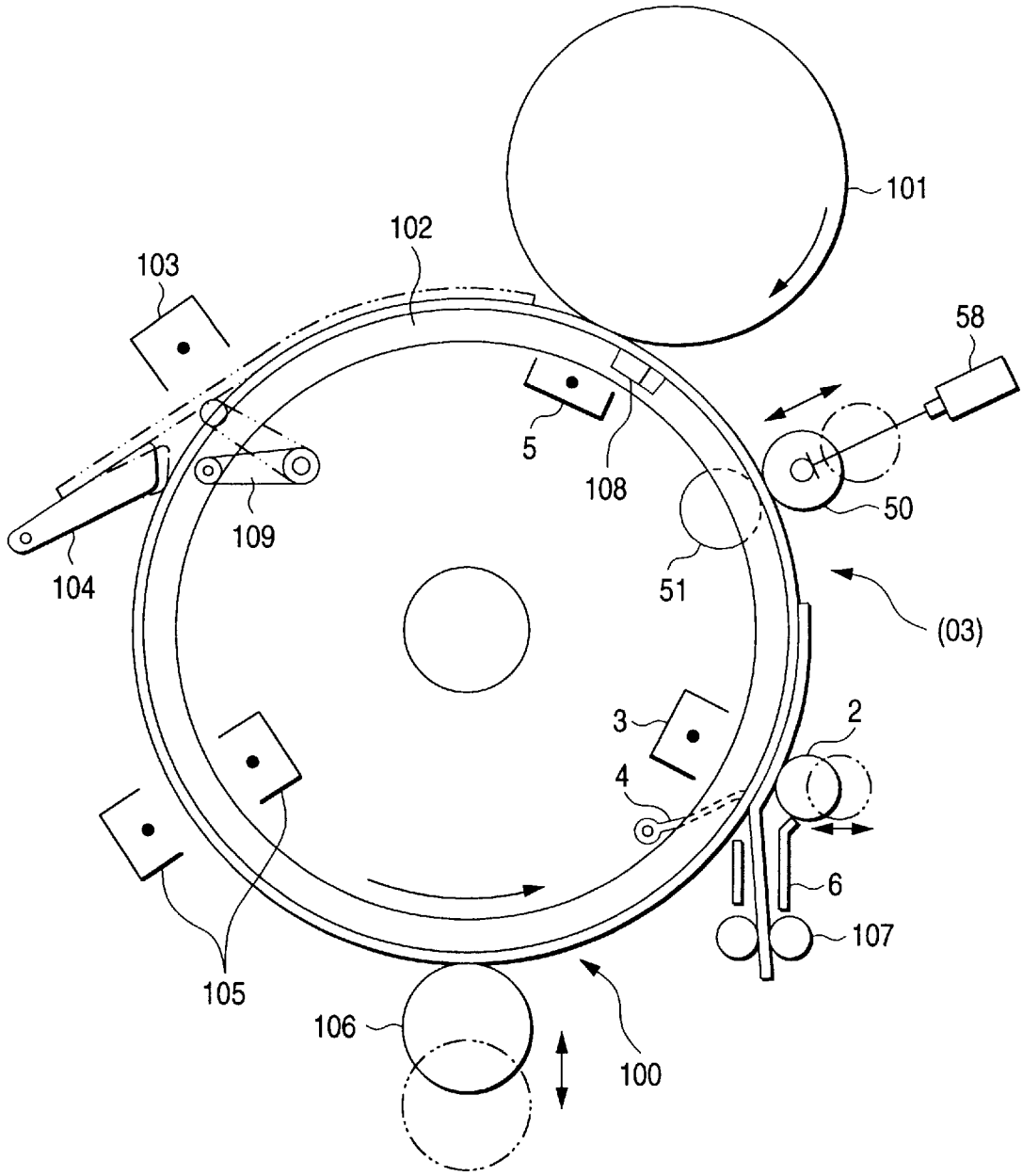
FIG. 16 is a diagram showing an embodiment of a recording-sheet adsorbing apparatus comprising a correction means according to the present invention.

Embodiment Relating to Recording-Sheet Adsorbing Apparatus Having Correction Means FIG. 16 shows an embodiment of a recording-sheet adsorbing apparatus having a correction means according to the present invention. Although a recording-sheet adsorbing apparatus (03) according to this embodiment is applied to the transfer drum 100, it may be applied to the transfer belt 200 (see FIG. 12A) similarly to the recording-sheet adsorbing apparatus (01) according to the foregoing embodiment.

Figure 19:
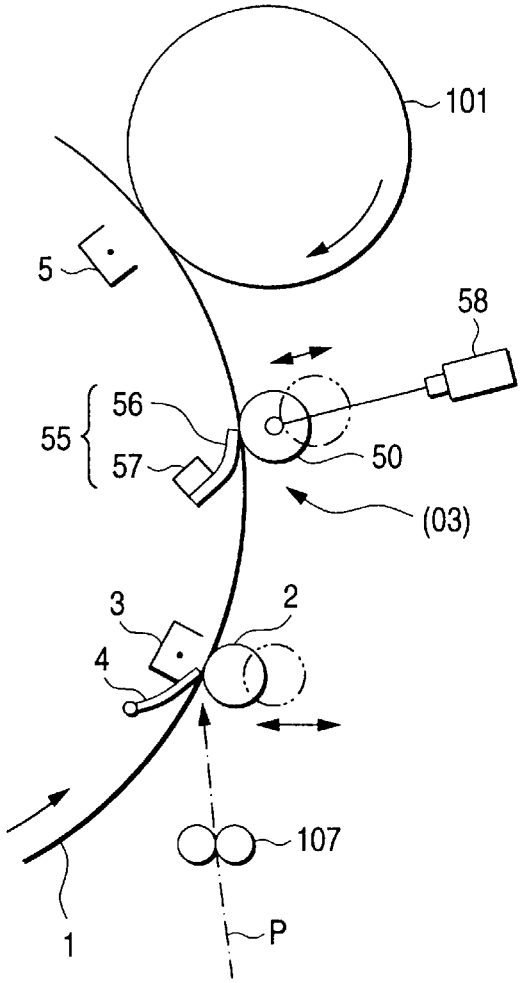
FIG. 19 is a diagram showing another embodiment of the recording-sheet adsorbing apparatus comprising the correction means according to the present invention.

The recording-sheet adsorbing apparatus (03) has a roll pair as shown in FIG. 16 or a roll and sheet pair as shown in FIG. 19 between the recording-sheet adsorbing apparatus (03) and a portion for electrostatically transferring a toner image which is formed downstream from the recording-sheet adsorbing apparatus (03) and in which the photosensitive drum 101 and the transfer corotron 5 are disposed opposite to each other. Further the roll pair or the roll and sheet pair applies pressure to the dielectric film 1 to which the recording sheet P has been adsorbed so as to correct a state of adsorption of the recording sheet P before the first transfer is performed (to perform a correction operation) so that waves of the recording sheet P after adsorption has been performed and the first transfer is performed are removed.

The recording-sheet adsorbing apparatus (03) has the main portion, similarly to the recording-sheet adsorbing apparatus (01) shown in FIG. 2, constructed by the cylindrical or columnar pressing roll 2 disposed to be in contact and moved away from the dielectric film 1 forming the transfer drum 100, the adsorbing corotron 3, the discharge restraining baffle 4 and the sheet moving guide plate 6, except for the roll pair shown in FIG. 16 or the roll and sheet pair shown in FIG. 19 is disposed between the recording-sheet adsorbing apparatus (03) and the transfer portion.

Figure 17:
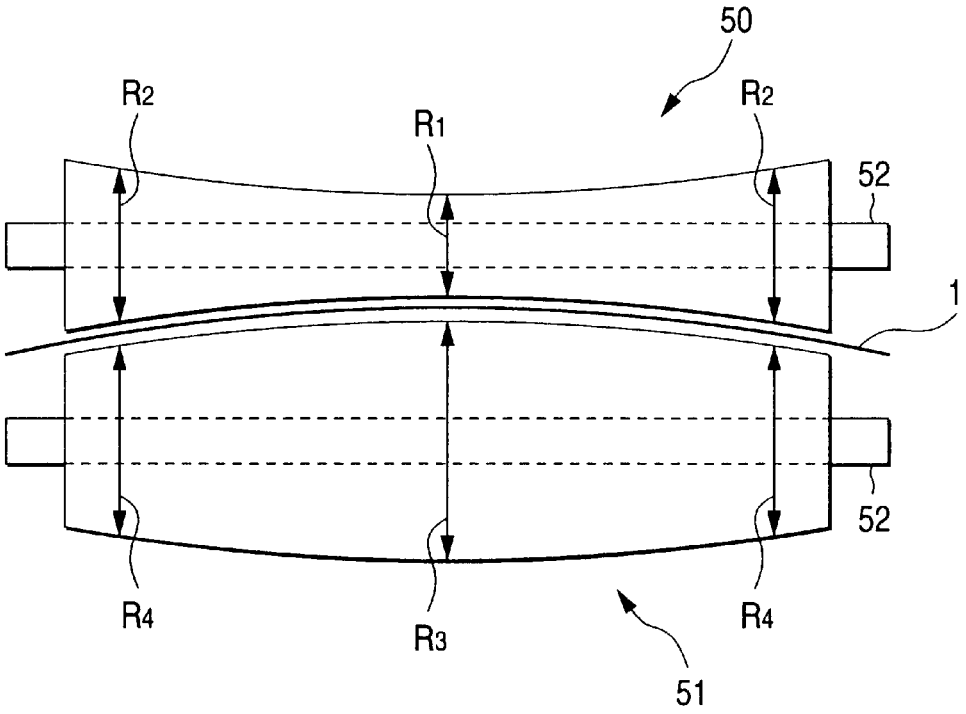
FIG. 17 is a front view showing a state of use of an inverted crown shape outer roll and a crown shape inner roll for use to form t correction means.

The roll pair shown in FIG. 16 is constructed by an outer roll 50 made of metal or plastic and an inner roll 51 made of metal or plastic, the outer roll 50 and the inner roll 51 being disposed opposite to each other across the dielectric film 1. The outer roll 50 is disposed to be capable of being brought into contact with the outer surface of the dielectric film 1 and separated from the same. Reference numeral 52 shown in FIG. 17 represents a roll shaft for the outer roll or the inner roll. Both of the outer roll 50 and the inner roll 51 may be formed into cylindrical shapes. It is preferable that the outer roll 50 has the inverted crown shape similar to the pressing roll 20 (see FIG. 3) and the inner roll 51 is formed into a crown shape which has central and end roll diameters R3 and R4 which have the contrary relationship with the inverted crown shape outer roll 50 (having central and end roll diameters $R_1$ and $R_2$) (that is, $R_1+R_3=R_2+R_4$), as shown in FIG. 17. In this case, the dielectric film 1 interposed between the outer roll 50 and the inner roll 51 is, as shown in FIG. 17, brought to a state in which the central portion is raised in the outward direction.

Therefore, the recording-sheet adsorbing apparatus (03) having the inverted crown shape outer roll 50 and the crown shape inner roll 51 to serve as the correction means causes the recording sheet P to be held by the roll pair (the dielectric film 1 is interposed on the reverse side) before the first transfer operation is performed when the recording sheet P in the waved state has been adsorbed to the dielectric film 1 of the transfer drum 100 so that pressure is applied in a state where the central portion of the sheet is raised. Thus, the recording sheet P is expanded to the right and left ends so that the state of adsorption in the wave form is corrected. Note that the outer roll 50 is arranged to be moved away from the transfer drum 100 after the recording sheet P, to which the toner image has been transferred (the outer roll 50 is in the foregoing state after this).

Figure 18:
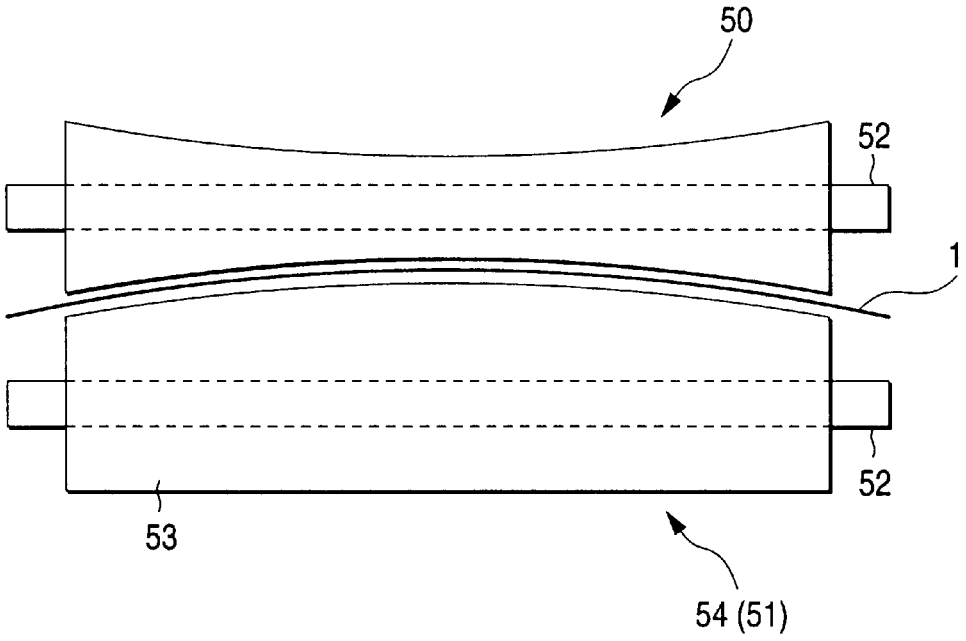
FIG. 18 is a front view showing a state of use of the inverted crown shape outer roll and an elastic inner roll for forming the correction means.

As an alternative to the crown shape inner roll 51, the roll pair may apply an elastic roll 54 in the form that the surface or the overall body of the roll body 53 is made of an elastic material such as rubber or sponge, as shown in FIG. 18. In this case, the outer surface of the elastic roll 54 opposite to the outer roll 50 is elastically deformed along the inverted crown shape of the outer roll 50. Moreover, the dielectric film 1 held between the elastic roll 54 and the outer roll 50 is brought to a state where the central portion of the dielectric film 1 is raised in the outward direction, as shown in FIG. 18.

When the elastic roll 54 is employed as the inner roll 51, the peripheral velocity of the two ends of the roll is higher than that of the central portion. Therefore, the recording sheet P is expanded to the right and left ends so that the state of adsorption of the waved recording sheet is corrected. Since the reverse side of the recording sheet P is pressed by the elastic member, the dielectric film 1 and the recording sheet P are deformed and can easily be brought into close contact with each other. As a result, the waved adsorption state of the recording sheet can easily be corrected.

Figure 20:
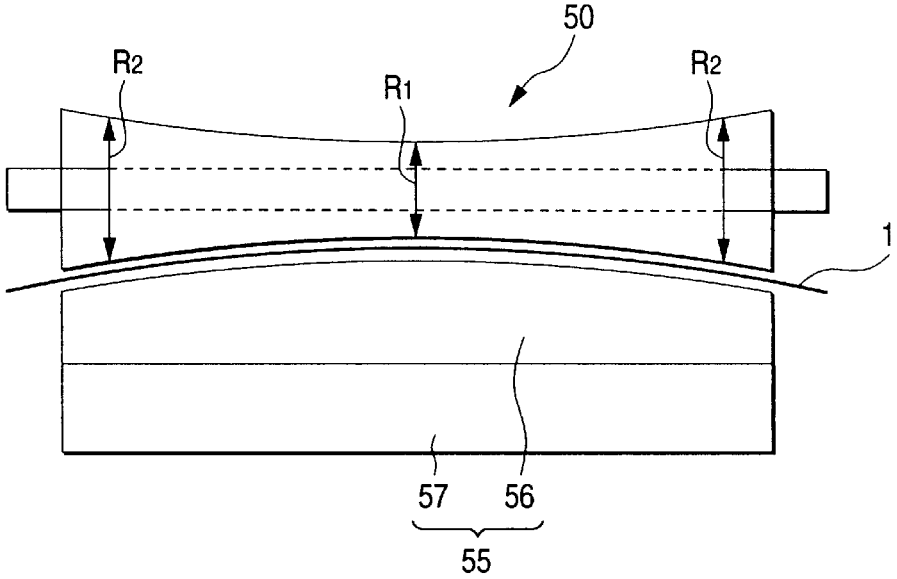
FIG. 20 is a front view showing a state of use of the inverted crown shape outer roll and the elastic sheet member for forming the Correction means.

On the other hand, the roll and sheet pair shown in FIG. 19 is constructed by the above-mentioned inverted crown shape outer roll 50 and the elastic sheet member 55 disposed opposite to the outer roll 50 in such a manner that the dielectric film 1 is interposed. The elastic sheet member 55 is constructed by an elastic sheet member 56 arranged to be brought into close contact with the inner surface of the dielectric film 1 and made of PET and the like and a support member 57 for supporting the elastic sheet member 56. In this case, the elastic sheet member 55 is elastically deformed along the outer surface of the inverted crown shape outer roll 50. Moreover, the dielectric film 1 held between the elastic sheet member 55 and the outer roll 50 is brought to a state where the central portion of the dielectric film 1 is raised in the outward direction, as shown in FIG. 20.

Therefore, also the recording-sheet adsorbing apparatus (03) having the inverted crown shape outer roll 50 and the elastic sheet member 55 serving as the correction means is able to correct the state of adsorption of the waved recording sheet adsorbed to the dielectric film 1, similarly to the recording-sheet adsorbing apparatus having the outer roll 50 and the elastic roll 54.

The outer roll 50 of the correction means may be provided with a pressure adjustment mechanism 58 for adjusting the pressure which be applied to the recording sheet on the outer roll 50 in accordance with the region of the recording sheet P, as shown in FIGS. 16 and 19. As the pressure adjustment mechanism 58, the contact-force adjustment mechanism 31 (see FIG. 13) for adjusting the contact force of the pressing roll 2 may be employed. Also adjustment of the pressure to be applied to the outer roll 50 which is performed by the pressure adjustment mechanism 58 is required to be performed in such a manner that the pressure is linearly raised from the leading end of the recording sheet P toward the rear end through the intermediate portion, similarly to the contact-force adjustment mechanism 31 for the pressing roll 2 (see FIG. 15).

When the outer roll 50 of the correction means is employed together with another expanding means and the temporal adsorbing means as described later, the outer roll 50 is not required to always be operated because waves of the recording sheet are previously removed by the expanding means and the temporal adsorbing means. Therefore, the outer roll 50 may be operated at only high humidity (for example, 70% R.H. to 85% R.H. or higher) at which the recording sheet is easily waved. In this case, environment measuring means, such as a humidity sensor, is required to be provided in the body of the copying machine or the like to bring the outer roll 50 into contact with the transfer drum 100 only when "high humidity" has been measured by the measuring means.

Embodiment Relating to Recording-Sheet Adsorbing Apparatus Having Two or More Units Among Expanding Means, Temporal Adsorbing Means and Correction Means A recording-sheet adsorbing apparatus (04) according to the present invention comprises two or more units selected from the expanding means, the temporal adsorbing means and the correction means. In this case, waves of the recording sheet can furthermore reliably be removed and the recording sheet can furthermore satisfactorily be adsorbed to the dielectric film.

Figure 21:
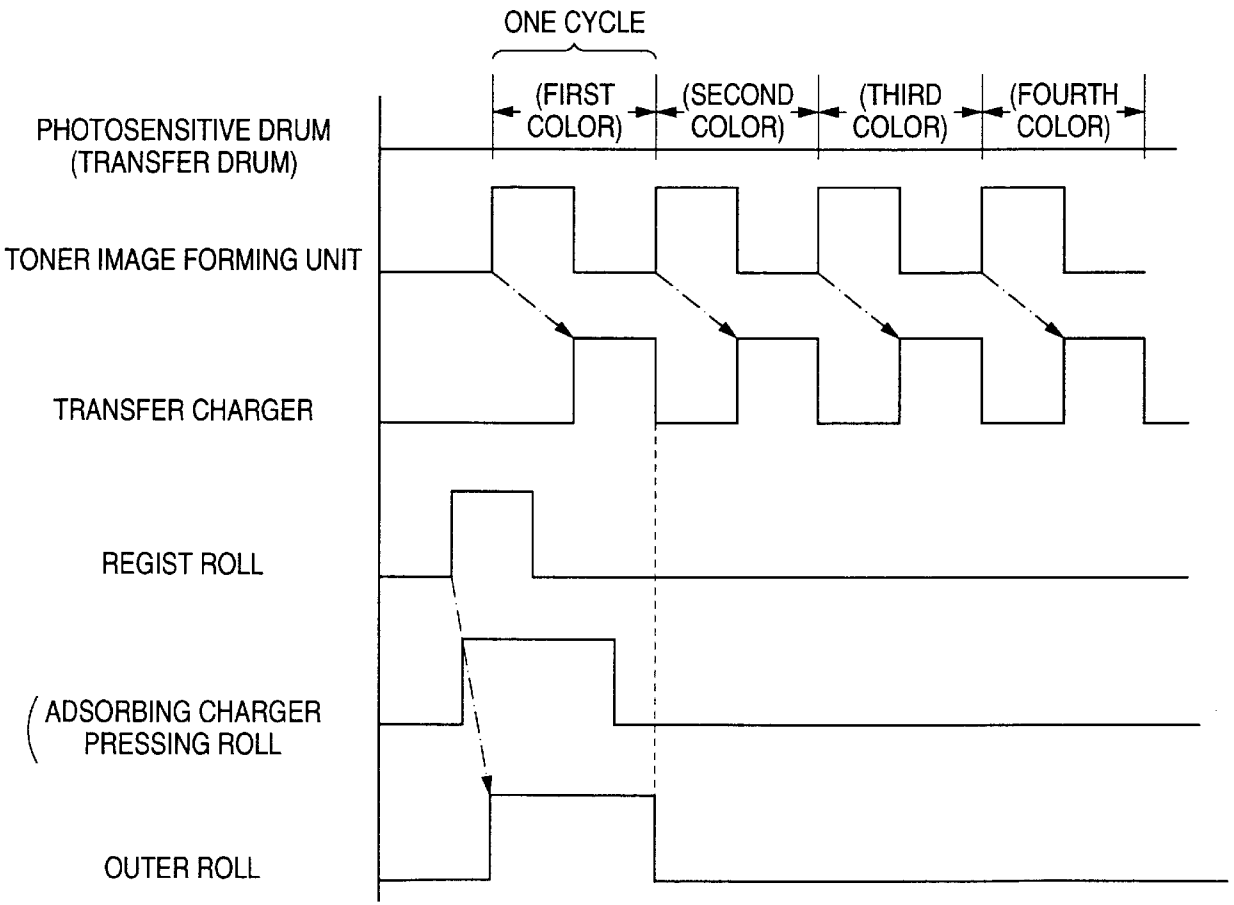
FIG. 21 is an operation timing chart of the recording-sheet adsorbing apparatus having the correction means.
Figure 22:
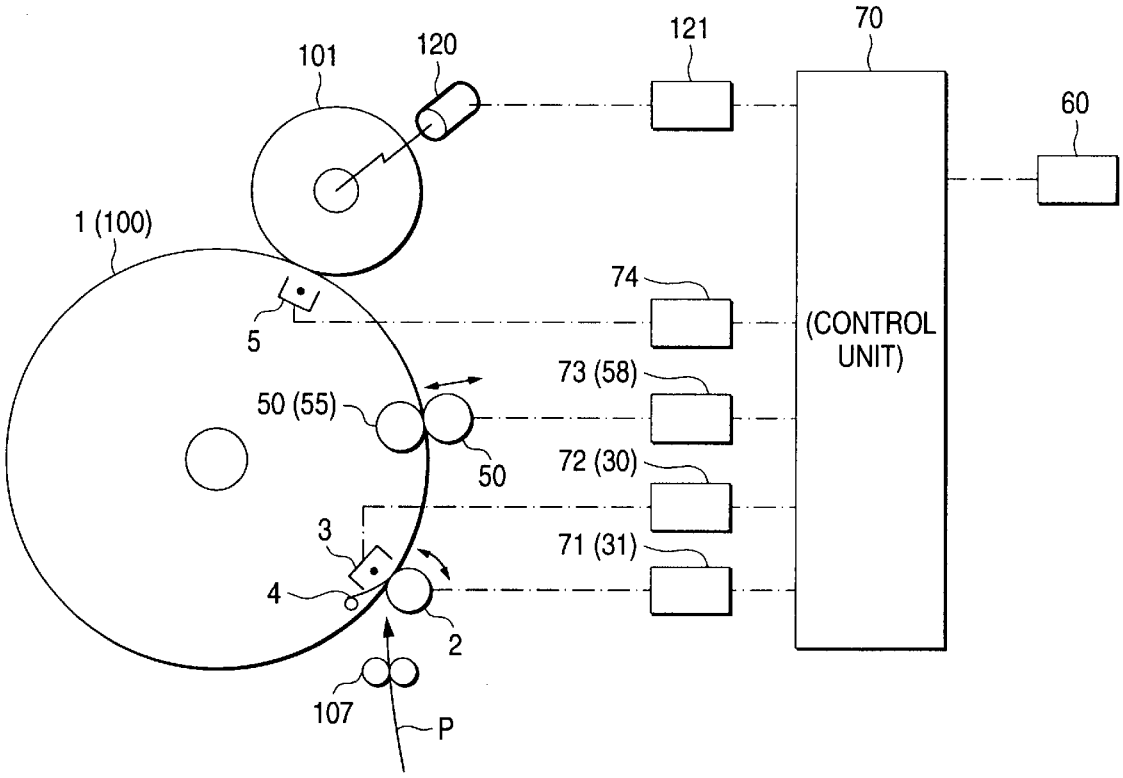
FIG. 22 is a diagram showing an embodiment of a recording-sheet adsorbing apparatus having an environment measuring means and control means according to the present invention.

Operation timing of an example of a recording-sheet adsorbing apparatus comprising the elements (pressing rolls 20, 23 and 24, the discharge restraining baffle 40 or contact-force adjustment mechanism 31 and the discharge-output control means 30) relating to the expanding means and the temporal adsorbing means and elements (the roll pair and the roll and sheet pair) relating to the correction means will now be described. FIG. 21 shows the operation timings of the recording-sheet adsorbing apparatus when an image forming process is performed in such a manner that toner images in four colors including black, yellow, magenta and cyan are multi-transferred.

Initially, the register roll 107 is operated so that the recording sheet P is transported to the transfer drum 100. After a predetermined time has elapsed from start of the operation of the register roll 107, the adsorbing corotron 3 starts discharge and simultaneously the pressing roll 2 is brought into contact with the transfer drum 100 so that a state is realized in which the recording sheet is adsorbed to the transfer drum 100. Note that the transfer drum 100 and the photosensitive drum 101 has synchronously be rotated when the register roll 107 is operated. After a predetermined time has elapsed from start of the operations of the adsorbing corotron 3 and the pressing roll 2, the outer roll 50 is brought into contact with the transfer drum 100 (note that the inner roll 51 and the elastic sheet member 55 are always in contact with the transfer drum 100). On the other hand, the toner image forming units, such as the charger, the image exposing unit and the developing unit are operated in synchronization with the feeding and adsorption operations of the recording sheet so that a toner image in the first color is formed on the photosensitive drum 101.

The recording sheet sent from the register roll 107 is expanded or temporarily adsorbed by the adsorbing corotron 3 or the pressing roll 2 forming the expanding means or the temporal adsorbing means so that waves are removed and the recording sheet is satisfactorily adsorbed to the surface of the transfer drum 100. Then, the recording sheet adsorbed to the transfer drum 100 is corrected when it passes between the outer roll 50 and the inner roll 51 or the elastic sheet member 55 so that the waved adsorption state is corrected.

Then, the transfer corotron 5 is operated in synchronization with the movement of the thus-adsorbed recording sheet to the transfer position at which the photosensitive drum 101 and the transfer corotron 5 are disposed attributable to the rotation of the transfer drum 100 so that the toner image in the first color is transferred to the recording sheet.

During the transference of the first color, the adsorbing corotron 3 interrupts discharge and the pressing roll 2 is separated from the transfer drum 100. When the toner image in the first color has been transferred, the outer roll 50 is separated from the transfer drum 100. The transfer drum 100, which adsorbs the recording sheet, on which the toner image in the first color has been transferred, is continuously rotated to pass through the adsorbing position, at which the adsorbing corotron 3 and the pressing roll 2 are disposed, and the correction position, at which the outer roll 50 is disposed, and then again transport the recording sheet to the transfer portion. On the other hand, a toner image in a second color is formed on the photosensitive drum 101, and then transferred to be placed on the recording sheet which has been again transported. Then, similar operations are performed so that toner images in third and fourth colors are transferred. The recording-sheet adsorbing apparatus interrupts the operation during the operation for transferring the toner image in the first color or immediate after the same. The recording-sheet adsorbing apparatus is not operated during the image forming cycles following the operation for the second color.

Embodiment Relating to Recording-Sheet Adsorbing Apparatus Having Means for Controlling Adsorption-Only Cycle Each of the recording-sheet adsorbing apparatuses (01, 02, 03 and 04) including any one of the expanding means, the temporal adsorbing means and the correction means or two or more units among the same may further include an environment measuring means 60, such as a humidity sensor, for measuring an environment state and a control means 70 arranged to perform an adsorption-only cycle for idling the dielectric film 1 forming the transfer drum 100 or the like one time to again pass the adsorbed recording sheet P below the recording-sheet adsorbing apparatus (01, 02, 03 or 04) and having a CPU and the like.

The control means 70 is connected to the environment measuring means 60 to receive a result of measurement. Moreover, the control means 70 is connected to a motor driver 121 of a drive motor 120 (in this case, the drive motor 120 is arranged to have a gear transmission mechanism or the like to transmit the rotational force to rotate the transfer drum 100) of the photosensitive drum 101 to transmit a signal for performing the adsorption-only cycle. When the measurement performed by the environment measuring means 60 has been resulted in high humidity, the control means 70 performs the adsorption-only for rotating the dielectric film 1 at idle prior to performing the first transfer operation (an operation for transferring a toner image in a first color in a case of a color image).

The control means 70 is connected to a contact/separation-operation driver 71 for causing the pressing roll 2 to be brought into contact with the transfer drum 100 and separated from the transfer drum 100, an adsorbing power source portion 72 for supplying an operation current to the adsorbing corotron 3, a contact-separation-operation driver 73 for causing the outer roll 50 to be brought into contact with the transfer drum 100 and separated from the transfer drum 100 and a transferring power source portion 74 for supplying an operation current to the transfer corotron 5. When the pressing roll 2 is employed as an element of the temporal adsorbing means, the contact/separation-effect driver 71 as well as serves as a driver for the contact-force adjustment mechanism 31. When the adsorbing corotron 3 is employed as an element of the temporal adsorbing means, the adsorbing power source portion 72 also serves as a driver for the discharge-output control means 30. When the pressure of the outer roll 50 is adjusted, the contact-separation-effect driver 73 as well as serves as a driver for the pressure adjustment mechanism 58.

Figure 23:
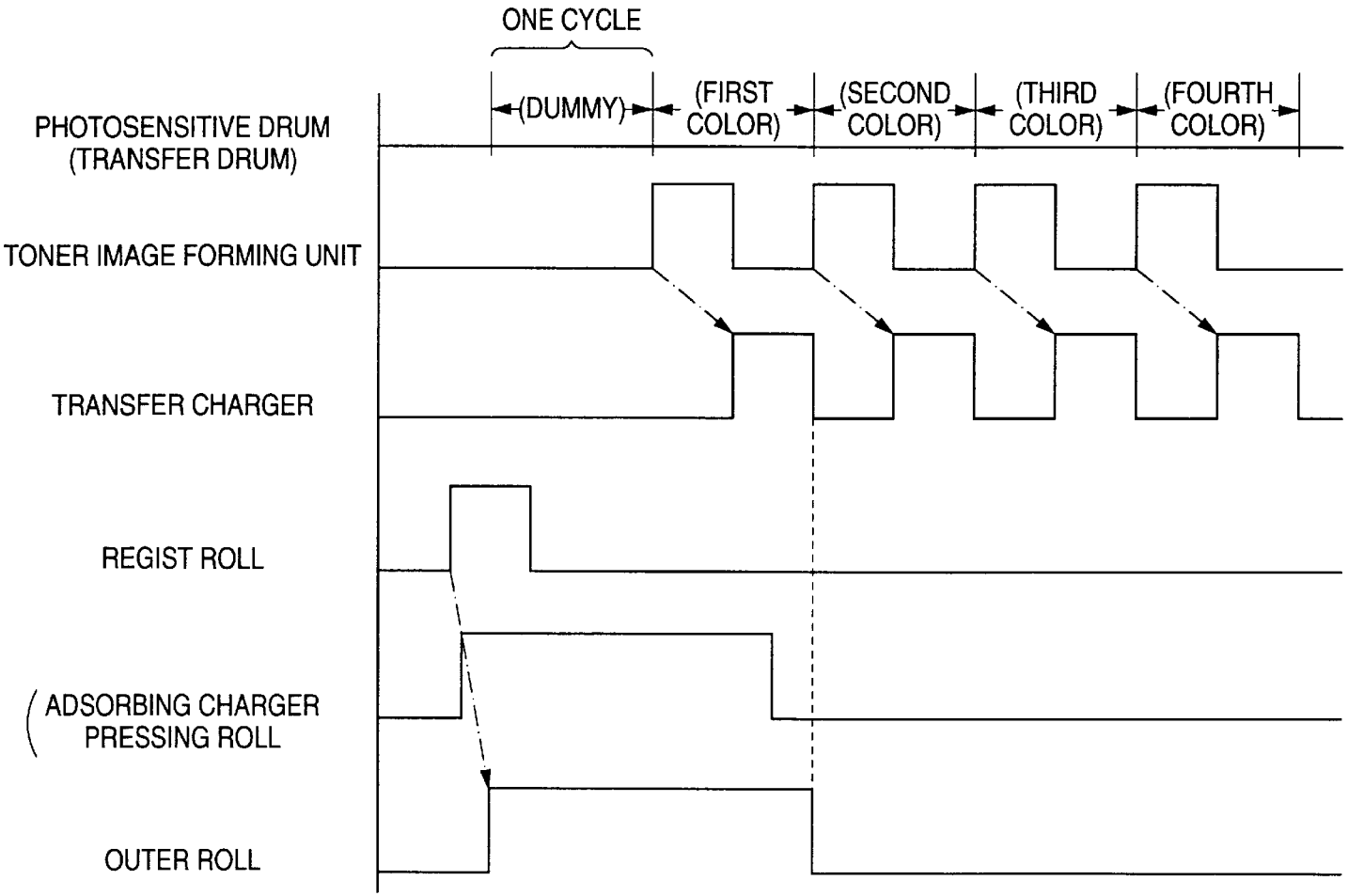
FIG. 23 is an operation timing chart of the adsorbing apparatus shown in FIG. 22 when an adsorption-only cycle is performed.

The operation of the recording-sheet adsorbing apparatus (05) comprising the environment measuring means 60 and the control means 70 will now be described. FIG. 23 shows the operation timing when the adsorption-only (dummy) cycle is performed.

When a result indicating high humidity (for example, 70% R.H. to 85% R.H.) is supplied from the environment measuring means 60 to the control means 70, the control means 70 determines that the adsorption-only (dummy) cycle is performed prior to performing the first transfer operation of a toner image, and then rotates the drive motor 120 through the motor driver 121 so that the transfer drum 100 is rotated free one time. In synchronization with the adsorption-only cycle, the control means 70 operates the register roll 107 to feed the recording sheet P. Moreover, the control means 70 brings the pressing roll 2 into contact with the transfer drum 100 through the contact/separation-effect driver 71. In addition, the control means 70 supplies an operation current to the adsorbing corotron 3 from the adsorbing power source portion 72 so that the charging operation is commenced. The transfer drum 100 adsorbs the recording sheet P in the nip portion between the transfer drum 100 and the pressing roll 2 in which the adsorbing corotron 3 being operated, and then rotates one time so as to again pass the recording sheet P through the nip portion. Then, a transfer cycle of a first toner image (in a first color) is commenced. The transfer corotron 5 is supplied with the operation current from the transferring power source portion 74 in synchronization with the movement of the recording sheet P after the adsorption-only has been performed, whereby the transfer corotron 5 is operated.

When the adsorption-only is performed, the recording sheet P is again allowed to pass through the nip portion before the transfer operation as well as the sheet adsorption operation. Therefore, the control means 70 controls to continuously operate the pressing roll 2 and the adsorbing corotron 3 even when the recording sheet P is again allowed to pass. As a result, the recording sheet P is expanded and temporarily adsorbed two times when the pressing roll 2 and the adsorbing corotron 3 are employed as the expanding means and the temporal adsorbing means. As a result, waves can furthermore reliably be removed. When the outer roll 50 or the like is employed as the correction means, the outer roll 50 is brought into contact with the transfer drum 100 through the contact-separation-operation driver 73 from the start of the adsorption-only to completion of the transfer cycle for the first color. In this case, the recording sheet P is corrected two times before the transfer operation so that waved state of adsorption is furthermore reliably corrected.

The control means 70 controls a discharge output from the adsorbing corotron 3 when the adsorption-only cycle is performed in such a manner that the output when the adsorption of the sheet is adsorbed is smaller than the output (a reference level required for adsorption) when the sheet is again allowed to pass. Since the recording sheet is, in this case, temporarily adsorbed when the adsorption is performed, waves can easily be recovered in the nip portion when the sheet is adsorbed. In addition, the recording sheet can easily be corrected when it passes through the outer roll 50 at the first time.

The control means 70 may be arranged to operate the transfer corotron 5 when the adsorption-only cycle is performed. In this case, the discharge output from the transfer corotron 5 when the adsorption-only cycle is performed is made to be smaller than the discharge output (the output required to perform transfer) when the transfer is performed. In this case, an advantage can be obtained in that the wave correction effect before the transfer can be improved.

Figure 24:
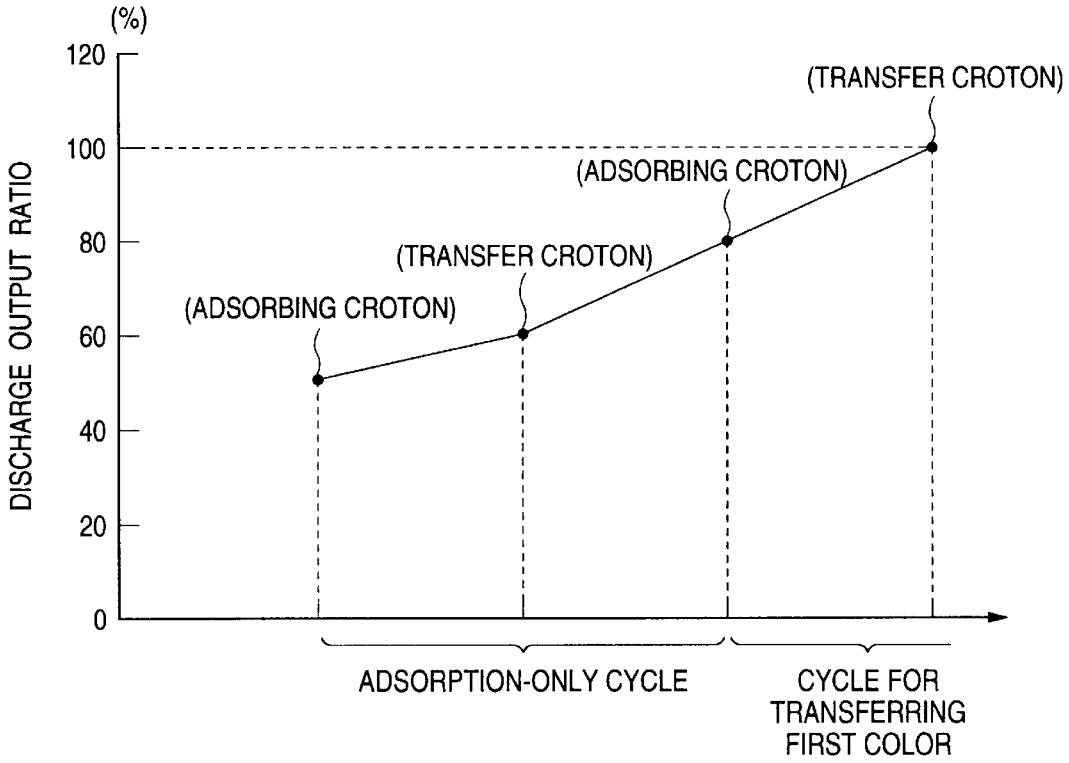
FIG. 24 is a graph showing an example of discharge output from each charge when the adsorption-only cycle is performed.
Figure 25:
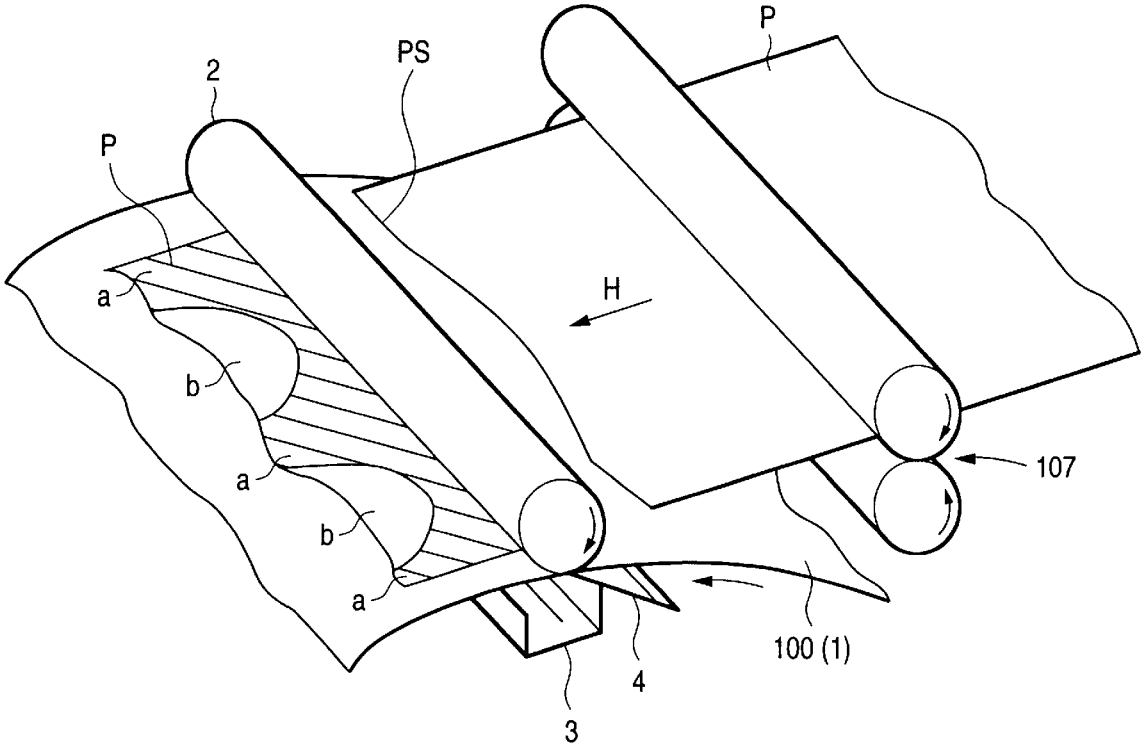
FIG. 25 is a diagram showing defective adsorption experienced with the conventional technique.

The control means 70 is able to perform control in such a manner that the operations of the pressing roll 2 and the adsorbing corotron 3 are continued or the transfer corotron 5 in the transfer portion is operated during the adsorption-only cycle is performed. When all of the pressing roll 2, the adsorbing corotron 3 and the transfer corotron 5 are operated, the ratio of the discharge outputs from the adsorbing corotron 3 and the transfer corotron 5 satisfy the value (discharge output ratio) as shown in FIG. 24. That is, in the example shown in FIG. 24 in which the discharge output from the transfer corotron 5 when the toner image in the first color is transferred is considered to be a reference which is 100%, the output from the adsorbing corotron 3 when the sheet is adsorbed during the adsorption-only cycle is minimized (about 50%), the next output from the transfer corotron 5 when the sheet is allowed to pass is made to be somewhat larger (about 60%), and the output from the adsorbing corotron 3 when the sheet is allowed to again pass is made to be further enlarged (80%) and the output from the transfer corotron 5 at the cycle for transferring the first color is made to be 100%.

As a result, when the adsorption-only cycle is performed, waves of the recording sheet can furthermore easily be removed when the sheet is adsorbed. In addition, the state of adsorption of the recording sheet on the transfer drum can furthermore easily be corrected. As a result, satisfactory adsorption of a recording sheet can reliably be realized.

Effect of the Invention

As described above, according to the present invention, even if a recording sheet has, immediately before it is introduced into the sheet adsorbing position (the nip portion), waves in the sheet moving direction or a direction perpendicular to the sheet moving direction attributable to moisture, the expanding means and the temporal adsorbing means remove the waves in the nip portion. As an alternative to this, the correction means removes the waved state of adsorption in a region from the nip portion and the transfer portion. Therefore, the recording sheet can uniformly and satisfactorily be adsorbed to the surface of the dielectric film, such as the transfer drum without generation of a non-adsorbed region. As a result, generation of defective transfer caused from defective adsorption can be prevented. The foregoing effect can furthermore reliably be obtained when at least two or more units among the expanding means, the temporal adsorbing means and the correction means are employed.

Each of the expanding means, the temporal adsorbing means and the correction means is able to prevent disadvantageous deformation when transfer to the dielectric film is performed and prevent generation of defective transfer caused from inward deformation of the dielectric film experienced from the conventional technique. In addition, employment of the expanding means, the temporal adsorbing means and the correction means prevents a problem of a great wave which is formed attributable to accumulation of waves of the recording sheet in the rear end portion of the sheet.

According to the present invention, a structure including an adsorption-only cycle which is performed when the humidity is high is able to further reliably remove waves from the recording sheet and correct waved state of adsorption on the dielectric film. As a result, satisfactory adsorption of the sheet and prevention of defective transfer can be performed.

What is claimed is:

1. A recording-sheet adsorbing apparatus comprising:

an endless dielectric film disposed to be rotatively movable, said dielectric film electrostatically absorbing a recording sheet; and a pressing member being brought into pressure contact with the outer surface of said dielectric film and transporting the recording sheet, wherein a transporting force of said pressing member for transporting the recording sheet is larger at both ends thereof than said transporting force at a central portion thereof.

2. A recording-sheet adsorbing apparatus according to claim 1, wherein said dielectric film is used as a recording-sheet adsorbing/transporting member for adsorbing and, at least one time, transporting the recording sheet to a transferring portion arranged to electrostatically transfer a toner image and formed downstream in a rotational direction, an adsorbing charger for charging said dielectric film when the recording sheet is adsorbed, is disposed opposite to said pressing member on an inner surface side of said dielectric film, and an elongated discharge-restraining sheet member for restraining a discharge region of said adsorbing charger is, in a state of covering a part of said adsorbing charger, disposed to be press-contactable with the inner surface of said dielectric film.

3. A recording-sheet adsorbing apparatus according to claim 2, wherein said pressing member comprises a pressing roll which a circumferential velocity of rotation at the both ends thereof is higher than the circumferential velocity of rotation at the central portion thereof.

4. A recording-sheet adsorbing apparatus according to claim 2, wherein said pressing member comprises a pressing roll which a pressing force for pressing said dielectric film at the both ends thereof is larger than the pressing force at the central portion thereof.

5. A recording-sheet adsorbing apparatus according to claim 2, wherein said pressing member comprises a pressing roll which a width of contact with said dielectric film at the both ends thereof is larger than the width of contact at the central portion thereof.

6. A recording-sheet adsorbing apparatus according to claim 5, wherein said pressing roll has an inverted crown shape formed in such a manner that a diameter of said pressing roll is minimized at the central portion thereof and the diameter thereof is enlarged in a direction toward each of the both ends thereof.

7. A recording-sheet adsorbing apparatus according to claim 5, wherein said pressing roll is sectioned at least three portions of the central portion and the both end portions.

8. A recording-sheet adsorbing apparatus according to claim 2, wherein, in said discharge-restraining sheet member, a width of a sheet free ends at both ends thereof is smaller than the width of the sheet free end at a central portion thereof.

9. A recording-sheet adsorbing apparatus according to claim 2, wherein, in said discharge-restraining sheet member, a pressing force for pressing said dielectric film at both ends thereof is smaller than the pressing force at a central portion thereof.

10. A recording-sheet adsorbing apparatus according to claim 2, further comprising:

environment measuring means for measuring an environmental state of the recording sheet; and control means for, prior to performing a first transfer operation by said transferring portion, performing an adsorption-only cycle for idly rotating said dielectric film one time so that said adsorbed recording sheet repasses under said recording-sheet adsorbing apparatus, when a result of measurement supplied from environment measuring means is a high humidity state.

11. A transfer apparatus according to claim 1, wherein said dielectric film is used as a toner carrier carrying a toner image being transferred in a transferring portion arranged to electrostatically transfer a toner-image, and a support roll in a secondary transferring portion for supporting the rotative movement of said dielectric film is disposed opposite to said pressing member on an inner surface side of said dielectric film.

12. A transfer apparatus according to claim 11, wherein said pressing member comprises a pressing roll having an inverted crown shape formed in such a manner that a diameter of said pressing roll is minimized at the central portion thereof and the diameter thereof is enlarged in a direction toward each of the both ends thereof.

13. A recording-sheet adsorbing apparatus comprising:

an endless dielectric film disposed to be rotatively movable and arranged to adsorb and transport a recording sheet to a portion arranged to electrostatically transfer a toner image and formed downstream in the direction of rotation;

a pressing roll disposed to be press-contactable with an outer surface of said dielectric film;

an adsorbing charger disposed opposite to said pressing roll on an inner surface side of said dielectric film;

an elongated discharge-restraining sheet member, in a state covering a part of said adsorbing charger, disposed to be press-contactable with said dielectric film and restraining a discharge region of said adsorbing charger;

a nip portion defined between said dielectric film and said pressing roll, the recording sheet introduced into said nip portion so as to electrostatically adsorb the recording sheet to said dielectric film; and temporary adsorbing means for temporarily adsorbing a leading end of the recording sheet in the moving direction with said dielectric film at said nip portion, said temporary adsorbing means having an adsorbing force at the leading end of the recording sheet which is smaller than the adsorbing force in a remaining sheet portion other than the leading end.

14. A recording-sheet adsorbing apparatus according to claim 13, wherein said temporary adsorbing means is discharge-output control means for controlling a discharge output from said adsorbing charger to satisfy the relationship that the output when the leading end of said sheet passes said adsorbing charger is not more than the output when said remaining sheet portion passes said adsorbing charger.

15. A recording-sheet adsorbing apparatus according to claim 13, wherein said temporary adsorbing means is a contact-pressure adjustment mechanism for adjusting a contact force from said pressing roll to satisfy the relationship that the contact force when the leading end of said sheet passes said pressing roll is not more than the contact force when said remaining sheet portion passes said pressing roll.

16. A recording-sheet adsorbing apparatus according to claim 13, wherein said temporary adsorbing means has discharge-output control means for controlling a discharge output from said adsorbing charger to satisfy the relationship that the output when the leading end of said sheet passes said adsorbing charger is not more than the output when said remaining sheet portion passes said adsorbing charger, and a contact-pressure adjustment mechanism for controlling a contact force from said pressing roll to satisfy the relationship that the contact force when the leading end of said sheet passes said pressing roll is not more than the contact force when said remaining sheet portion passes said pressing roll.

17. A recording-sheet adsorbing apparatus according to claim 13, further comprising:

environment measuring means for measuring an environmental state of the recording sheet; and control means for, prior to performing a first transfer operation by said transferring portion, performing an adsorption-only cycle for idly rotating said dielectric film one time so that said adsorbed recording sheet repasses under said recording-sheet adsorbing apparatus, when a result of measurement supplied from environment measuring means is a high humidity state.

18. A recording-sheet adsorbing apparatus comprising:

an endless dielectric film disposed to be rotatively movable and arranged to adsorb and transport a recording sheet to a transferring portion arranged to electrostatically transfer a toner image and formed downstream in the direction of rotation;

a pressing roll disposed to be press-contactable with an outer surface of said dielectric film;

an adsorbing charger disposed opposite to said pressing roll on an inner surface side of said dielectric film;

an elongated discharge-restraining sheet member, in a state covering a part of said adsorbing charger, disposed to be press-contactable with said dielectric film and restraining a discharge region of said adsorbing charger;

a nip portion defined between said dielectric film and said pressing roll, the recording sheet introduced into said nip portion so as to electrostatically adsorb the recording sheet to said dielectric film; and correction means disposed upstream of said transferring portion and downstream of said adsorbing charger in a rotational direction, said correction means applying pressure to said dielectric film to which the recording sheet is adsorbed so as to correct a state of adsorption of the recording sheet before a first transfer is performed.

19. A recording-sheet adsorbing apparatus according to claim 18, wherein said correction means has an outer roll disposed to be contactable/separatable with the outer surface of said dielectric film and an inner roll disposed to be brought into contact with the inner surface of said dielectric film at a position opposite to said outer roll.

20. A recording-sheet adsorbing apparatus according to claim 19, wherein said outer roll has an inverted crown shape formed in such a manner that a diameter of said pressing roll is minimized at a central portion thereof and the diameter thereof is enlarged in a direction toward each of both ends thereof.

21. A recording-sheet adsorbing apparatus according to claim 19, wherein said inner roll is formed by at least one of a crown shape roll and an elastic roll, each of which has an inverse proportional diameter relationship with said outer roll in a direction from a central portion toward both ends.

22. A recording-sheet adsorbing apparatus according to claim 18, wherein said correction means has an outer roll disposed to be contactable/separatable with the outer surface of said dielectric film, and an elastic sheet member disposed to be brought into contact with the inner surface of said dielectric film at a position opposite to said outer roll.

23. A recording-sheet adsorbing apparatus according to claim 18, further comprising:

an environmental measuring means for measuring an environmental state of the recording sheet, wherein said correction means operates only when a result of measurement supplied from environment measuring means is a high humidity state.

24. A recording-sheet adsorbing apparatus according to claim 18, wherein said correction means has a pressure adjustment mechanism for adjusting the pressure to be applied to said dielectric file to satisfy the relationship that the pressure when a leading end of said sheet passes is not more than a second pressure when a remaining sheet portion other than said leading end passes.

25. A recording-sheet adsorbing apparatus according to claim 18, further comprising:

environment measuring means for measuring an environmental state of the recording sheet; and control means for, prior to performing a first transfer operation by said transferring portion, performing an adsorption-only cycle for idly rotating said dielectric film one time so that said adsorbed recording sheet repasses under said recording-sheet adsorbing apparatus, when a result of measurement supplied from environment measuring means is a high humidity state.

26. A recording-sheet adsorbing apparatus comprising:

an endless dielectric film disposed to be rotatively movable and arranged to adsorb and transport a recording sheet to a portion arranged to electrostatically transfer a toner image and formed downstream in the direction of rotation;

a pressing roll disposed to be press-contactable with an outer surface of said dielectric film;

an adsorbing charger disposed opposite to said pressing roll on an inner surface side of said dielectric film;

an elongated discharge-restraining sheet member, in a state covering a part of said adsorbing charger, disposed to be press-contactable with said dielectric film and restraining a discharge region of said adsorbing charger;

a nip portion defined between said dielectric film and said pressing roll, the recording sheet introduced into said nip portion so as to electrostatically adsorb the recording sheet to said dielectric film; and further comprising at least two means of:

expanding means for expanding the recording sheet at said nip portion from a central portion of the recording sheet in a sheet moving direction toward both ends thereof;

temporary adsorbing means for temporarily adsorbing a leading end of the recording sheet in the moving direction with said dielectric film at said nip portion, said temporary adsorbing means having an adsorbing force at the leading end of the recording sheet which is smaller than the adsorbing force in a remaining sheet portion other than the leading end; and correction means disposed in a upstream of the transferring portion in a rotational direction, said correction means applying pressure to said dielectric film to which the recording sheet is adsorbed so as to correct a state of adsorption of the recording sheet before a first transfer is performed.

27. A recording-sheet adsorbing apparatus according to claim 26, further comprising:

environment measuring means for measuring an environmental state of the recording sheet; and control means for, prior to performing a first transfer operation by said transferring portion, performing an adsorption-only cycle for idly rotating said dielectric film one time so that said adsorbed recording sheet repasses under said recording-sheet adsorbing apparatus, when a result of measurement supplied from environment measuring means is a high humidity state.

28. A recording-sheet adsorbing apparatus according to claim 27, wherein said control means controls to maintain an operation of said pressing roll and said adsorbing charger during execution of said adsorption-only cycle.

29. A recording-sheet adsorbing apparatus according to claim 28, wherein said control means controls a discharge output from said adsorbing charger during execution of said adsorption-only cycle so as to satisfy the relationship that the output when said recording sheet is adsorbed is not more than the output when said sheet is repassed.

30. A recording-sheet adsorbing apparatus according to claim 27, wherein said control means controls in such a manner that a transfer charger of said transferring portion is operated when said adsorption-only cycle is performed.

31. A recording-sheet adsorbing apparatus according to claim 30, wherein said control means controls in such a manner that a discharge output of said transfer charger during said adsorption-only cycle is smaller than the discharge output thereof when the transfer operation is performed.

32. A recording-sheet adsorbing apparatus according to claim 27, wherein said control means controls during execution of said adsorption-only cycle in such a manner that an operation of said pressing roll and said adsorbing charger are maintained, said transfer charger of a transferring portion is operated, and outputs of said adsorbing charger and said transfer charger satisfy that said output from said adsorbing chamber when said recording sheet is adsorbed is not more than said output from said transfer charger which is not more than said output from said adsorbing charger when said recording sheet is repassed.

* * * * *